US010274986B2

(12) United States Patent
Yung et al.

(10) Patent No.: US 10,274,986 B2
(45) Date of Patent: Apr. 30, 2019

(54) CURRENT-CONTROLLED VOLTAGE REGULATION

(71) Applicant: Qualcomm Incorporated, San Diego, CA (US)

(72) Inventors: Chi Fan Yung, Singapore (SG); Xiaodan Zou, Singapore (SG); Ngai Yeung Ho, San Diego, CA (US); Hua Guan, San Diego, CA (US); Kan Li, Singapore (SG)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/713,215

(22) Filed: Sep. 22, 2017

(65) Prior Publication Data

US 2018/0284830 A1 Oct. 4, 2018

Related U.S. Application Data

(60) Provisional application No. 62/479,825, filed on Mar. 31, 2017.

(51) Int. Cl.

| | |
|---|---|
| ***G05F 1/575*** | (2006.01) |
| ***G05F 1/66*** | (2006.01) |
| ***G05F 1/569*** | (2006.01) |
| *G05F 1/573* | (2006.01) |

(52) U.S. Cl.

CPC ..... *G05F 1/66* (2013.01); *G05F 1/569* (2013.01); *G05F 1/573* (2013.01); *G05F 1/575* (2013.01)

(58) Field of Classification Search

CPC ..... G05F 1/565; G05F 1/569; G05F 1/573; G05F 1/575; G05F 1/59; G05F 1/66

See application file for complete search history.

(56) References Cited

U.S. PATENT DOCUMENTS

| | | | | |
|---|---|---|---|---|
| 7,518,348 | B1 | 4/2009 | Kobayashi | |
| 7,612,549 | B1 * | 11/2009 | Kao | G05F 1/575 323/274 |
| 7,863,881 | B2 * | 1/2011 | Inoue | G05F 1/575 323/282 |
| 8,729,880 | B2 | 5/2014 | McCloy-Stevens et al. | |
| 9,134,743 | B2 | 9/2015 | Bisson et al. | |
| 9,170,594 | B2 | 10/2015 | Bhattad et al. | |
| 9,429,971 | B2 | 8/2016 | Mallala et al. | |

(Continued)

*Primary Examiner* — Matthew V Nguyen

(74) *Attorney, Agent, or Firm* — Colby Nipper/ Qualcomm

(57) ABSTRACT

An integrated circuit is disclosed for current-controlled voltage regulation. In an example aspect, the integrated circuit includes a voltage regulator and a current-controlled clamp. The voltage regulator has a regulator output node and produces a regulator current. The voltage regulator includes an error amplifier and an output transistor. The error amplifier has first and second input nodes and an error amplifier output node, with the first input node coupled to a reference voltage. The error amplifier generates an error amplifier output voltage at the output node. The output transistor is coupled between the error amplifier output node and the regulator output node. The output transistor is coupled to the second input node via the regulator output node to establish a feedback path for the voltage regulator. The current-controlled clamp is coupled to the error amplifier output node and clamps the error amplifier output voltage based on the regulator current.

30 Claims, 16 Drawing Sheets

(56) References Cited

U.S. PATENT DOCUMENTS

| | | | | |
|---|---|---|---|---|
| 9,712,061 | B1 * | 7/2017 | Newlin | H02M 1/32 |
| 2005/0184717 | A1 * | 8/2005 | Walters | H02M 3/156 323/284 |
| 2009/0128112 | A1 * | 5/2009 | Xu | H02M 1/32 323/282 |
| 2009/0273331 | A1 * | 11/2009 | Inoue | G05F 1/575 323/312 |

* cited by examiner

CURRENT-CONTROLLED VOLTAGE REGULATION

CROSS-REFERENCE TO RELATED APPLICATION

This application claims the benefit of U.S. Provisional Application No. 62/479,825, filed 31 Mar. 2017, the disclosure of which is hereby incorporated by reference in its entirety herein.

TECHNICAL FIELD

This disclosure relates generally to voltage regulation with integrated circuits (ICs) that are used in electronic devices and, more specifically, to regulating an output voltage of a voltage regulator based on an estimation of a current flowing within the voltage regulator.

BACKGROUND

Power consumption by electronic devices is an increasingly important factor in the design of electronic devices. From a global perspective, the energy consumption of electronic devices occupies a sizable percentage of total energy usage due to large corporate data centers and the ubiquity of personal computing devices. Environmental concerns thus motivate efforts to reduce the power consumed by electronic devices to help conserve the earth's resources. From an individual perspective, less power consumption translates to lower energy bills. Furthermore, many personal computing devices are portable and powered by batteries. The less energy that is consumed by a portable battery-powered electronic device, the longer the portable device can operate without recharging the battery. Lower energy consumption also enables the use of smaller batteries and the adoption of thinner form factors, which means electronic devices can be made more portable or versatile. Thus, the popularity of portable devices also motivates efforts to reduce the power consumption of electronic devices.

An electronic device consumes power if the device is coupled to a power source and is turned on. This is true for the entire electronic device, but it is also true for individual parts of the electronic device. Hence, power consumption can be reduced if parts of an electronic device are powered down, even while other parts remain powered up. Entire discrete components of an electronic device, such as a whole integrated circuit (IC) or a Wi-Fi radio, may be powered down. Alternatively, selected parts of a discrete component may likewise be powered down. For example, a distinct processing entity or a circuit block of an integrated circuit chip, such as a core thereof, may be selectively powered down for some period of time to reduce energy consumption.

A portion of an integrated circuit, such as a core, can therefore be powered down to reduce power usage and extend battery life. A core can be powered down by, for example, decoupling the core from a power source or otherwise causing the core to cease drawing an appreciable current level. Generally, if a core is not drawing current, the core is not consuming power. A strategy of turning off the current drawn by a core does reduce energy consumption. Unfortunately, this strategy also strains the operation of a power supply for the core.

In modern electronic devices, a power management integrated circuit (PMIC) generates and provides voltages for different loads, such as a core of an integrated circuit. The PMIC can be disposed on the same integrated circuit as the core being powered or a different integrated circuit. The PMIC is responsible for providing a stable, steady voltage to the core to enable the core to operate properly. During standard operation or as part of a power-conserving strategy, the core can draw a load current that fluctuates over time. Nevertheless, a voltage regulator of the PMIC is expected to be capable of maintaining a regulated output voltage level as the load current changes over time.

However, the ability of a voltage regulator to provide a stable output voltage is undermined if a load current of a load repetitively falls to a low current level and then climbs to a high current level. In response to such sudden repetitive changes in the load current, the voltage regulator provides an output voltage that exhibits a pronounced dip, such as by as much as 40% below a set point for the output voltage. This dip on the output voltage adversely affects the performance of the load. For example, the ability of a core to correctly perform processing operations is jeopardized, such as by slowing processing throughput while the voltage is being stabilized or even causing data to become corrupted. These concerns have hindered the rate at which cores can be powered down and therefore the ability of integrated circuits to conserve power by reducing the current flow to a circuit load.

SUMMARY

An integrated circuit is disclosed for current-controlled voltage regulation in which an error amplifier output voltage is clamped based on a regulator current flowing within a voltage regulator. In an example aspect, the integrated circuit includes a voltage regulator and a current-controlled clamp. The voltage regulator has a regulator output node and is configured to produce at least one regulator current. The voltage regulator includes an error amplifier and an output transistor. The error amplifier has a first input node, a second input node, and an error amplifier output node, with the first input node coupled to a reference voltage. The error amplifier is configured to generate an error amplifier output voltage at the error amplifier output node. The output transistor is coupled between the error amplifier output node and the regulator output node. The output transistor is coupled to the second input node of the error amplifier via the regulator output node to establish a feedback path for the voltage regulator. The current-controlled clamp is coupled to the error amplifier output node and is configured to clamp the error amplifier output voltage based on the at least one regulator current.

In an example aspect, an integrated circuit is disclosed. The integrated circuit includes a voltage regulator. The voltage regulator has a regulator output node and is configured to produce at least one regulator current. The voltage regulator includes an error amplifier and an output transistor. The error amplifier has a first input node, a second input node, and an error amplifier output node, with the first input node coupled to a reference voltage. The error amplifier is configured to generate an error amplifier output voltage at the error amplifier output node based on voltages at the first input node and the second input node. The output transistor is coupled between the error amplifier output node and the regulator output node. The output transistor is coupled to the second input node of the error amplifier via the regulator output node to establish a feedback path for the voltage regulator. The integrated circuit also includes current-controlled means for clamping the error amplifier output voltage based on the at least one regulator current.

In an example aspect, a method for current-controlled voltage regulation is disclosed. The method includes generating an error amplifier output voltage based on a reference voltage and a feedback voltage. The method also includes generating a regulator output voltage based on the error amplifier output voltage using a buffer that conducts at least one regulator current. The feedback voltage is provided based on the regulator output voltage. The method additionally includes estimating a level of the at least one regulator current to produce an estimated current. The method further includes clamping the error amplifier output voltage based on the estimated current.

In an example aspect, an integrated circuit is disclosed. The integrated circuit includes a voltage regulator, a current estimator, and an error amplifier voltage clamp. The voltage regulator includes an error amplifier, a buffer, and an output transistor. The error amplifier is configured to generate an error amplifier output voltage at an error amplifier output node. The buffer is coupled to the error amplifier output node and is configured to conduct at least one regulator current. The output transistor is coupled to the buffer and is configured to generate a regulator output voltage at a regulator output node based on the error amplifier output voltage. The current estimator is configured to estimate the at least one regulator current of the buffer to produce an estimated current. The error amplifier voltage clamp is coupled to the current estimator and is configured to clamp the error amplifier output voltage based on the estimated current.

BRIEF DESCRIPTION OF DRAWINGS

FIG. 5-1 illustrates an example voltage regulator of the voltage regulation circuitry.

FIG. 5-2 illustrates an example current estimator of the voltage regulation circuitry.

FIG. 5-3 illustrates an example error amplifier voltage clamp of the voltage regulation circuitry.

FIG. 6-1 illustrates an example implementation of voltage regulation circuitry having an N-type metal-oxide-semiconductor (NMOS) output transistor.

FIG. 6-2 illustrates the example implementation of voltage regulation circuitry having the NMOS output transistor of FIG. 6-1, with an overlay of components as depicted in FIG. 3.

FIG. 6-3 illustrates the example implementation of voltage regulation circuitry having the NMOS output transistor of FIG. 6-1, with an overlay of the components as depicted in FIGS. 4-5 in addition to those of FIG. 3.

FIG. 7-1 illustrates an example implementation of voltage regulation circuitry having a P-type metal-oxide-semiconductor (PMOS) output transistor.

FIG. 7-2 illustrates the example implementation of voltage regulation circuitry having the PMOS output transistor of FIG. 7-1, with an overlay of components as depicted in FIG. 3.

FIG. 7-3 illustrates the example implementation of voltage regulation circuitry having the PMOS output transistor of FIG. 7-1, with an overlay of the components as depicted in FIGS. 4-5 in addition to those of FIG. 3.

DETAILED DESCRIPTION

Figure 1:
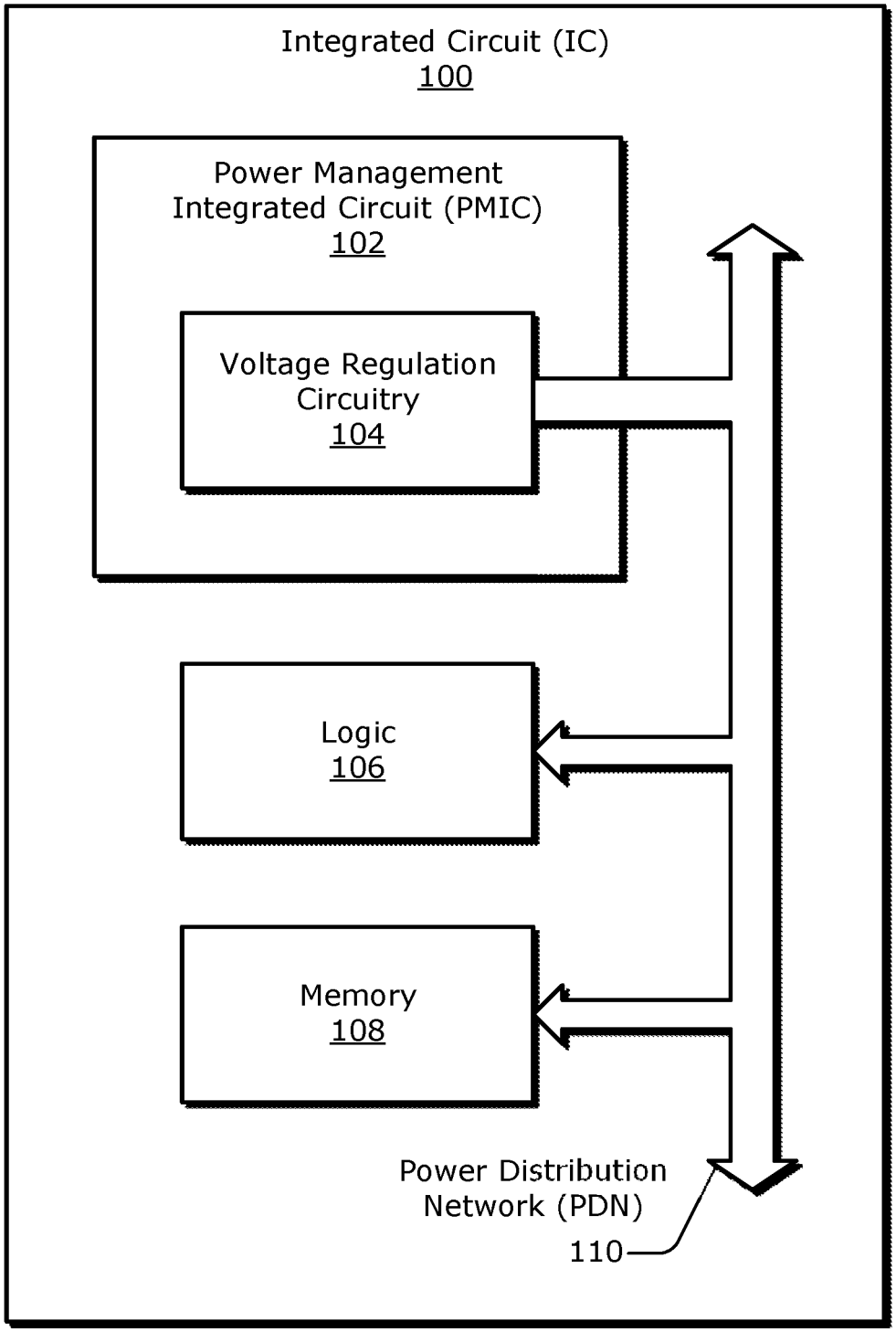
FIG. 1 illustrates an example integrated circuit with a power management integrated circuit (PMIC) that includes voltage regulation circuitry.

Power management of electronic devices entails controlling an amount of energy that an integrated circuit (IC) consumes over time or on an instantaneous basis. Energy consumption can be reduced to zero or near zero during times of nonuse if an integrated circuit is powered down completely. At times of lower utilization or to retain some stored data, an integrated circuit may be powered down to a lower voltage level to reduce power consumption. Also, if an integrated circuit cannot be powered down as a whole, then one or more portions, or cores, may be powered down independently of each other. An example power management technique therefore involves turning a core on or off. As a result of this core-level power cycling, the load current drawn by a core can repetitively swing from a relatively high current level to a relatively low, or negligible, current level.

In an electronic device, a power source, such as a power management integrated circuit (PMIC), provides a load current to a circuit load. The PMIC provides an output voltage at an output node, and the output node also provides the load current to a core or other load. Because loads operate more reliably with stable voltages, a PMIC typically includes a voltage regulator. The voltage regulator is intended to automatically maintain a constant voltage level at the output node across different operating points of the load, such as across different levels of load current being drawn by the load. An example of a voltage regulator is a low-dropout voltage regulator (e.g., a low-dropout (LDO) voltage regulator).

On the one hand, LDO voltage regulators offer a number of advantages. Advantages include a lack of switching noise, a relatively small size, and a relatively simple design. On the other hand, LDO voltage regulators also introduce a number of disadvantages to the voltage regulation process. One disadvantage of LDO voltage regulators, regardless of topology, pertains to the development of voltage dips at the regulator output node. Specifically, LDO voltage regulators suffer from an excessive voltage dip of the regulator output voltage when the regulator output node is subjected to a repetitive load attack. With a repetitive load attack, the load draws a load current intermittently at least at a relatively low level and a relatively high level. For instance, the load may draw a load current at a relatively high level, followed by a relatively low level, and then followed again by a relatively high level. This repetitive load attack pattern that causes problems with LDO voltage regulators unfortunately matches the current draw pattern of a core that is being turned off at times to conserve power. Hence, it can be problematic to combine an LDO voltage regulator with a power management technique that involves turning a core on and off repetitively.

A typical LDO voltage regulator includes a reference voltage, an error amplifier, and a pass transistor. The pass transistor establishes the regulator output voltage at the regulator output node based on a voltage output by the error amplifier. The error amplifier produces the voltage output based on the reference voltage and a feedback voltage, which has a voltage level that is responsive to voltage level of the regulator output voltage. During a repetitive current-based attack on a load, the load current drops from a relatively high level to a relatively low level. As a result of the load current drop, an output capacitor collects charge, and the regulator output voltage increases above a nominal level. Because this voltage increase is propagated as the feedback voltage at an input of the error amplifier, the error amplifier begins to rail out toward the ground. The voltage output by the error amplifier therefore begins to deviate from regulation. When the load again raises the load current draw to the relatively high level, the low voltage level of the voltage output of the error amplifier causes the error amplifier to be slow to bring the regulator feedback system back into regulation. Consequently, the regulator output voltage at the regulator output node experiences a relatively significant voltage dip responsive to the onset of the load current increasing to a relatively high current level from a relatively low current level. For example, the voltage dip can exceed 40% of the nominal voltage level for the regulator output voltage. This excessive voltage dip adversely impacts an ability of the load to perform reliably.

To counteract the conditions that cause such an excessive voltage dip, the voltage output by the error amplifier can be clamped to a voltage level matching that of the error amplifier operating in regulation. An example approach for an error amplifier clamp operates in the voltage domain. A voltage-controlled clamp uses a feedback system that clamps the output voltage of the error amplifier based on the voltage level of the output voltage of the error amplifier. The voltage-controlled clamp includes an offset circuit, a voltage amplifier, and a voltage pulling device. The offset circuit can be formed using resistors. The voltage amplifier takes as input the output voltage of the error amplifier and an offset version of an intended voltage level for the output voltage of the error amplifier while the error amplifier is operating in regulation.

Thus, to implement this voltage-mode approach to clamping, the intended voltage level for the output voltage of the error amplifier while operating in regulation is also to be generated. Generating such an intended voltage level can be accomplished with an N-type metal-oxide-semiconductor (NMOS) LDO voltage regulator, but such generation consumes an appreciable area of the integrated circuit. Moreover, generating such an intended voltage level for a P-type metal-oxide-semiconductor (PMOS) LDO voltage regulator is far more difficult. Regardless, the voltage generation circuitry, the offset circuit, the voltage amplifier, and the voltage pulling devices together consume a significant area of an integrated circuit chip.

In contrast, example approaches as described herein operate in the current domain. A current-controlled clamp opposes changes to an error amplifier output voltage if the changes deviate from a regulation voltage level for the output of the error amplifier. The current-controlled clamp pulls on the error amplifier output voltage based on a current that flows through a voltage regulator of which the error amplifier forms a part. Example implementations for a current-mode clamp on the error amplifier output voltage occupy a smaller area on an integrated circuit chip as compared to the voltage-mode clamps described above. For instance, a current-mode clamp can occupy an area that is on the order of 10-times (10×) smaller than that of a voltage-mode clamp.

In some example implementations, an integrated circuit has voltage regulation circuitry including a voltage regulator and a current-controlled clamp. The voltage regulator has a regulator output node and produces at least one regulator current. The voltage regulator includes an error amplifier and an output transistor. The error amplifier has a first input node, a second input node, and an error amplifier output node, with the first input node coupled to a reference voltage. The error amplifier generates an error amplifier output voltage at the error amplifier output node. The output transistor is coupled between the error amplifier output node and the regulator output node. The output transistor is coupled to the second input node of the error amplifier via the regulator output node to establish a feedback path for the voltage regulator. The current-controlled clamp is coupled to the error amplifier output node and clamps the error amplifier output voltage based on the regulator current.

In other example implementations, the voltage regulator further includes a buffer that is coupled to the error amplifier output node and includes a branch in which the regulator current flows during operation of the voltage regulation circuitry. The output transistor is also coupled to the buffer and generates a regulator output voltage at the regulator output node based on the error amplifier output voltage. The current-controlled clamp includes a current estimator and an error amplifier voltage clamp. The current estimator estimates the regulator current of the branch in the buffer of the voltage regulator to produce an estimated current. The error amplifier voltage clamp is coupled to the current estimator and clamps the error amplifier output voltage based on the estimated current.

In still other example implementations, the current estimator includes a current mirror having a parallel circuit arrangement with respect to the branch in the buffer of the voltage regulator. The parallel circuit arrangement produces the estimated current to be substantially similar to the at least one regulator current of the branch in the buffer. The error amplifier voltage clamp includes a difference determiner and a voltage pulling device. The difference determiner is coupled to the current estimator to receive the estimated current and produces a current difference indicator based on a regulation current and the estimated current. A current source provides the regulation current at a current level or magnitude that reproduces the regulator current that flows through the branch in the buffer if the voltage regulator is operating in regulation. The voltage pulling device is coupled to the difference determiner to receive the current difference indicator and adjusts the error amplifier output voltage based on the current difference indicator.

The voltage pulling device adjusts or pulls the error amplifier output voltage in a manner that opposes a tendency of the error amplifier output to move toward a voltage rail if a load current drops to a relatively low level after being at a relatively high level. This facilitates a faster recovery by the voltage regulator to an in-regulation level for the regulator output voltage responsive to an onset of the load current returning to the relatively high level. In these manners, a current-controlled clamp enables a voltage regulator to withstand a repetitive load attack using approximately 10× less area as compared to that occupied by a voltage-controlled clamp. Moreover, a current-mode clamp can be implemented in conjunction with an NMOS voltage regulator or a PMOS voltage regulator, including LDO voltage regulators employing a pass transistor of either type.

FIG. 1 illustrates an example integrated circuit 100 (IC) with a power management integrated circuit 102 (PMIC) that includes voltage regulation circuitry 104. As shown, the integrated circuit 100 also includes logic 106, memory 108, and a power distribution network 110 (PDN). The power management integrated circuit 102 provides power for the integrated circuit 100. The power management integrated circuit 102 generates at least one voltage and supplies the voltage to other parts of the integrated circuit 100, such as one or more circuit loads. Examples of loads include the logic 106 and the memory 108; however, other numbers and types of loads may alternatively be implemented on the integrated circuit 100. The supply voltage is provided to the logic 106 and the memory 108 via the power distribution network 110. Although shown as part of the same integrated circuit 100, the power management integrated circuit 102 may alternatively be disposed on an integrated circuit that is separate from the logic 106 or the memory 108.

The logic 106 and the memory 108 are enabled to draw current via the supply voltage distributed by the power distribution network 110 to power logical and storage operations, respectively. The logic 106 and the memory 108 are expected to function within established specifications such that the components correctly provide the intended logical and storage functionality at a given operational clock frequency. To ensure that the logic 106 and the memory 108 can function within the prescribed specifications, the power management integrated circuit 102 is designed to provide a stable voltage level. The power management integrated circuit 102 is intended to provide the stable voltage level across different, changing current levels that are drawn by various loads. The logic 106 and the memory 108 are designed to draw relatively higher levels of current during periods of relatively higher utilization and relatively lower levels at other times.

To supply a stable voltage level, the power management integrated circuit 102 includes voltage regulation circuitry 104. The voltage regulation circuitry 104 is designed to attempt to provide a steady output voltage for the power distribution network 110 across a range of currents drawn by different loads at different times. Further, the voltage regulation circuitry 104 is intended to maintain the steady output voltage as the currents drawn along the power distribution network 110 change, such as responsive to the logic 106 or the memory 108 being powered down to reduce power consumption and conserve power. The voltage regulation circuitry 104 can include a voltage regulator, which is described with reference to FIG. 2.

Figure 2:
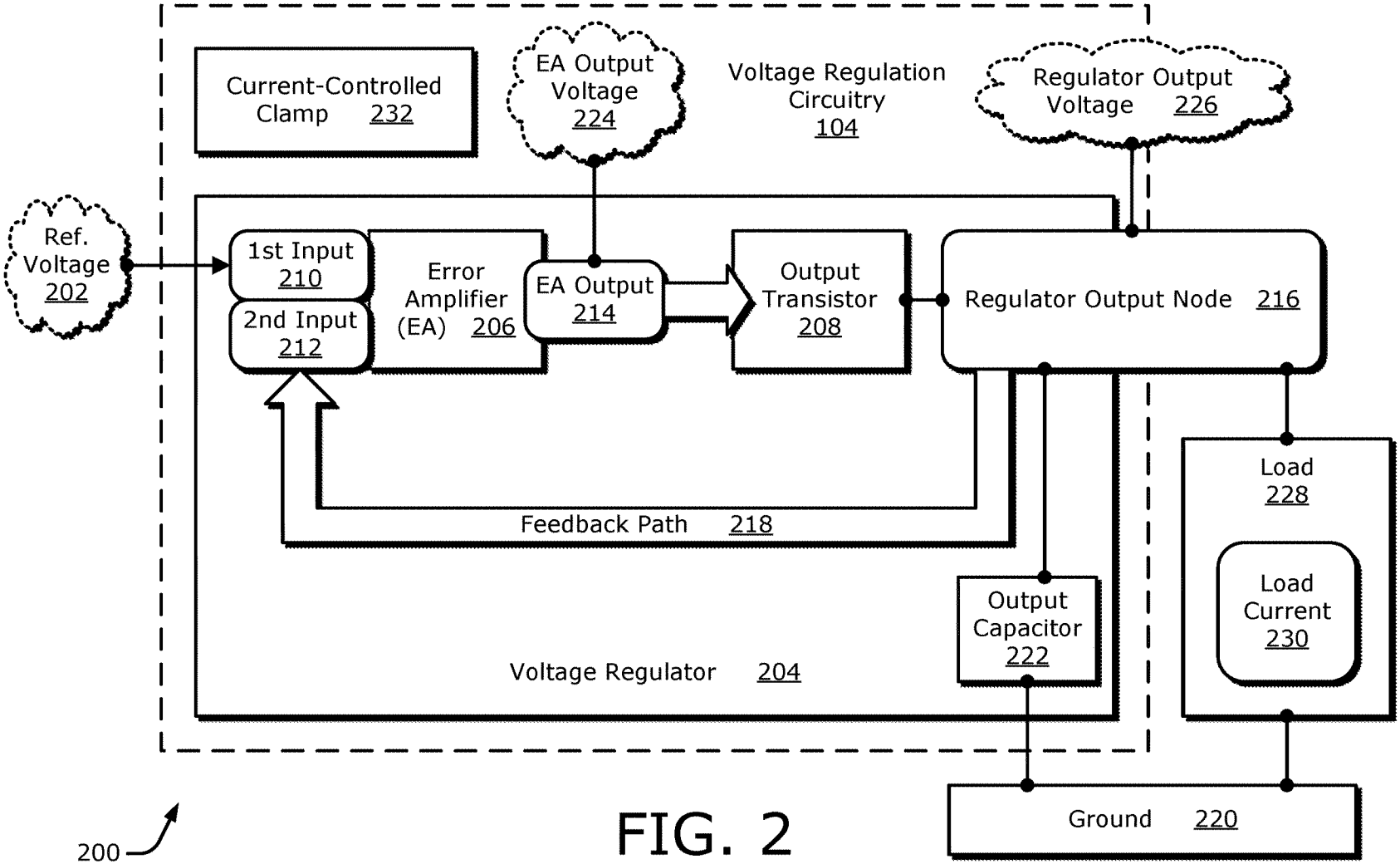
FIG. 2 illustrates an example of a load and voltage regulation circuitry in which the voltage regulation circuitry includes a voltage regulator that provides a regulator output voltage to the load via a regulator output node.

FIG. 2 illustrates generally at 200 an example of voltage regulation circuitry 104 and a load 228. The voltage regulation circuitry 104 includes a voltage regulator 204 that provides a regulator output voltage 226 to the load 228 via a regulator output node 216. In addition to the voltage regulator 204, the voltage regulation circuitry 104 also includes a current-controlled clamp 232. The voltage regulation circuitry 104 holds the regulator output node 216 at the regulator output voltage 226. The load 228 is coupled between the regulator output node 216 and the ground 220, or another equipotential node or chip interconnect. In operation, the load 228 draws a load current 230 from the voltage regulation circuitry 104 via the regulator output node 216. With reference also to FIG. 1, the regulator output node 216 can correspond to the power distribution network 110, and the load 228 can correspond to the logic 106, the memory 108, and so forth.

To generate the regulator output voltage 226, the voltage regulation circuitry 104 includes the voltage regulator 204. By way of example, the voltage regulator 204 is illustrated as a low-dropout (LDO) voltage regulator 204, but other voltage regulator types may alternatively be implemented in conjunction with the current-controlled clamp 232. The voltage regulator 204 includes an error amplifier 206, an output transistor 208, and a feedback path 218. The error amplifier 206 includes three nodes: a first input node 210, a second input node 212, and an error amplifier output node 214. The output transistor 208 is coupled between the error amplifier output node 214 and the regulator output node 216. An output capacitor 222 is coupled between the regulator output node 216 and the ground 220. The feedback path 218 couples the regulator output node 216 back to the second input node 212 of the error amplifier 206.

In operation, the voltage regulator 204 generates the regulator output voltage 226 at the regulator output node 216. The feedback path 218 couples the regulator output voltage 226, or at least a voltage that is dependent on the regulator output voltage 226, to the second input node 212 of the error amplifier 206. The error amplifier 206 receives a reference voltage 202 at the first input node 210. Based on the reference voltage 202 and the regulator output voltage 226, the error amplifier 206 produces an error amplifier output voltage 224 at the error amplifier output node 214. The error amplifier 206 can be implemented as, for example, an operational amplifier. The error amplifier 206 can therefore generate the error amplifier output voltage 224 based on a difference between the reference voltage 202 and the regulator output voltage 226, or a feedback-based derivation thereof.

The output transistor 208 functions as a pass component (e.g., a pass transistor) for the voltage regulator 204. The output transistor 208 is controlled responsive to the error amplifier output voltage 224. Thus, the output transistor 208 generates the regulator output voltage 226 at the regulator output node 216 based on the error amplifier output voltage 224. The output transistor 208 can be implemented as, for example, a power field effect transistor (FET), a power bipolar junction transistor (BJT), and so forth. Due to the feedback path 218 and the functionality of the error amplifier 206, the voltage regulator 204 attempts to maintain the regulator output voltage 226 at a stable voltage level based on the reference voltage 202 as applied to the first input node 210 of the error amplifier 206.

However, if the load current 230 of the load 228 climbs to a relatively high current level after being at a relatively low current level, the regulator output voltage 226 can be dragged down below the intended stable voltage level while the error amplifier 206 and the regulator feedback system struggle to bring the regulator output voltage 226 back to the intended stable voltage level. To reduce the amount of voltage dip of the regulator output voltage 226 that occurs at the regulator output node 216 or to reduce the amount of time that the regulator output voltage 226 experiences a voltage dip due to the sudden increase in the draw of the load current 230, the current-controlled clamp 232 is employed. To achieve a voltage-dip size reduction or a voltage-dip duration reduction, the current-controlled clamp 232 clamps the error amplifier output voltage 224 at the error amplifier output node 214 of the error amplifier 206 as described with reference to FIG. 3.

Figure 3:
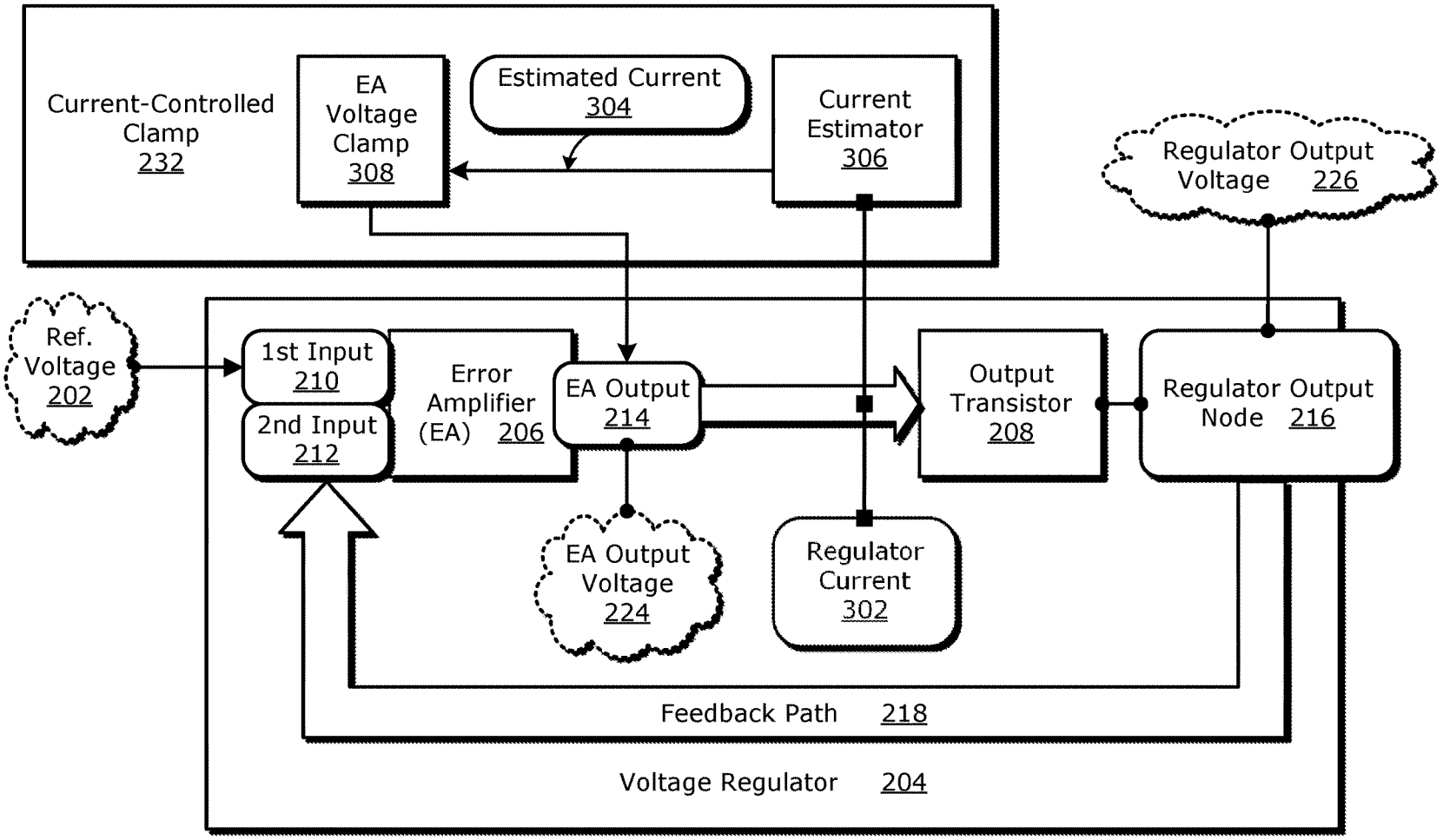
FIG. 3 illustrates an example of voltage regulation circuitry including a voltage regulator and a current-controlled clamp.

FIG. 3 illustrates an example of voltage regulation circuitry 104 including a voltage regulator 204 and a current-controlled clamp 232. The voltage regulator 204 includes the error amplifier 206 and the output transistor 208. The error amplifier 206 includes the first input node 210, the second input node 212, and the error amplifier output node 214. The output transistor 208 is coupled between the error amplifier output node 214 and the regulator output node 216. During operation, the voltage regulator 204 produces at least one regulator current 302. For example, a buffer for the output transistor 208 can have the regulator current 302 flowing at least while the voltage regulator 204 is operating in regulation.

The current-controlled clamp 232 includes a current estimator 306 and an error amplifier voltage clamp 308. The current estimator 306 estimates the regulator current 302 of the voltage regulator 204 to produce an estimated current 304. The current estimator 306 communicates or provides the estimated current 304 to the error amplifier voltage clamp 308. Based on the estimated current 304, the error amplifier voltage clamp 308 clamps the error amplifier output voltage 224 at the error amplifier output node 214 of the error amplifier 206. For example, the error amplifier voltage clamp 308 can adjust (e.g., pull up or pull down) the error amplifier output voltage 224 based on the estimated current 304.

Generally, the current-controlled clamp 232 implements a clamping feedback system to help the voltage regulator 204 maintain a stable level for the regulator output voltage 226 even if the regulator output node 216 is being subjected to a repetitive load current attack. The current-controlled clamp 232 retards the regulator output voltage 226 from developing a voltage dip as an increased load current is suddenly drawn by a load. To do so, the error amplifier voltage clamp 308 clamps the error amplifier output voltage 224 at the error amplifier output node 214 so as to resist the tendency of the error amplifier 206 to deviate toward a voltage rail responsive to a period of decreased load current draw that precedes the sudden increase in load current draw. The clamping is performed based on the estimated current 304 such that the regulator current 302 is to be returned to a current level that flows if the voltage regulator 204 is operating in accordance with regulation parameters. The clamping feedback system of the current-controlled clamp 232 is described further with reference to FIG. 4, and then also with joint reference to FIGS. 5 and 5-1 to 5-3.

Figure 4:
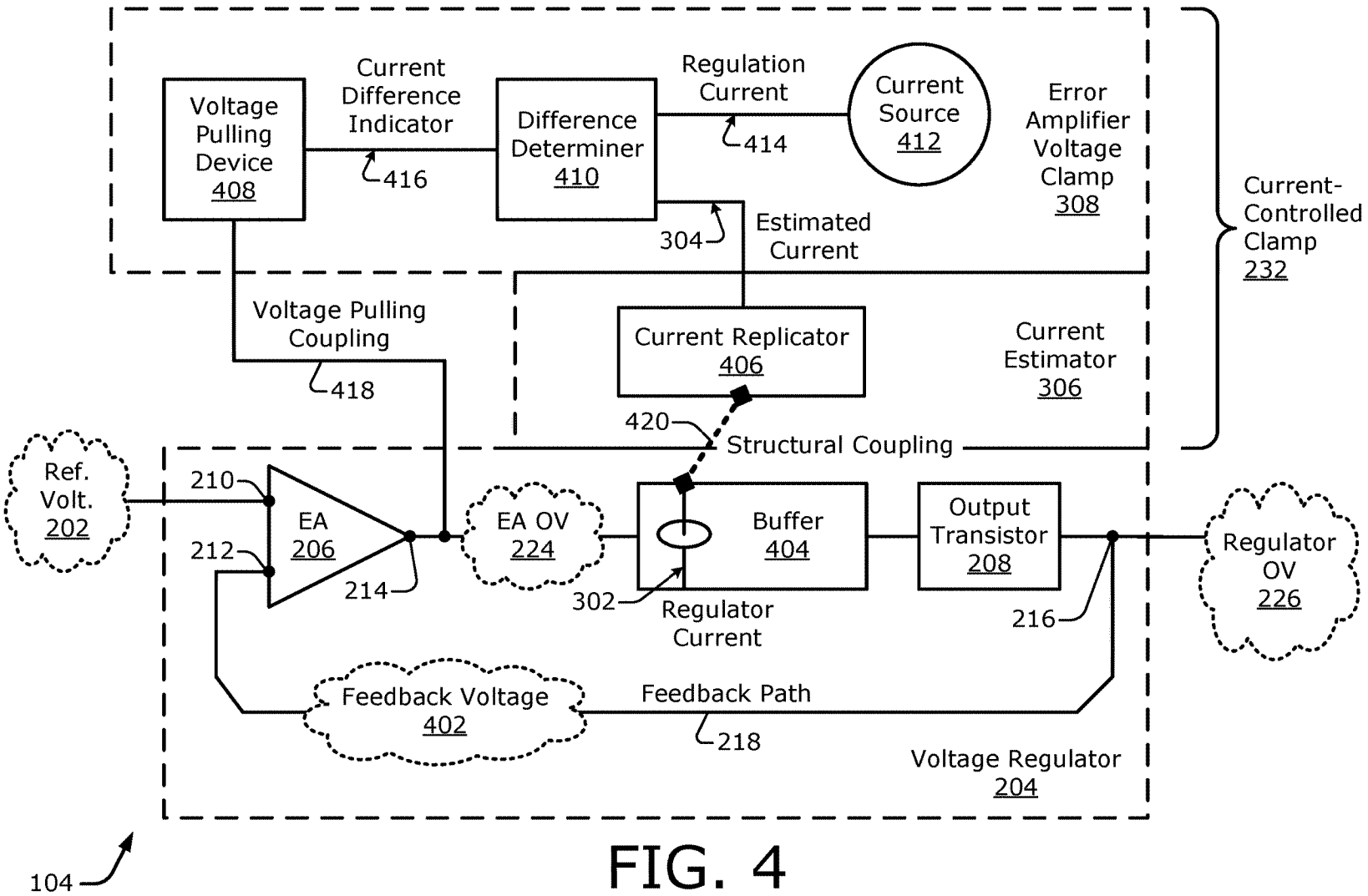
FIG. 4 illustrates another example of voltage regulation circuitry including a voltage regulator and a current-controlled clamp, which includes a current estimator and an error amplifier voltage clamp.

FIG. 4 illustrates another example of voltage regulation circuitry 104 including a voltage regulator 204 and a current-controlled clamp 232, which includes a current estimator 306 and an error amplifier voltage clamp 308. The voltage regulator 204 includes the error amplifier 206 and the output transistor 208, which are also shown in FIG. 3. In FIG. 4, the voltage regulator 204 additionally includes a buffer 404 coupled between the error amplifier output node 214 of the error amplifier 206 and the output transistor 208. As shown, a feedback voltage 402 is coupled to the second input node 212 of the error amplifier 206. The feedback voltage 402 is a voltage level that is based on the regulator output voltage 226 as modified or otherwise affected by any active or passive circuit devices disposed along the feedback path 218.

During operation, the regulator current 302 flows within the buffer 404 at different current levels under different operating conditions. For example, the regulator current 302 flows at one current level if the voltage regulator 204 is operating within regulation and at another current level if the voltage regulator 204 deviates from being in regulation, such as if the regulator output voltage 226 rises or dips responsive to a repetitive load current attack. The current estimator 306 estimates a level at which the regulator current 302 is flowing through the buffer 404.

The current estimator 306 includes a current replicator 406. The current replicator 406 is designed to replicate at least one characteristic of the buffer 404 so as to create a semblance or reproduction of (but not necessarily an exact facsimile of) at least one regulator current 302 that is flowing in at least one branch of the buffer 404. To do so, the current replicator 406 of the current estimator 306 forms a structural coupling 420 with the buffer 404 of the voltage regulator 204. For example, two transistors can be connected so as to experience similar voltage conditions such that the two transistors produce substantially similar current levels. The current replicator 406 of the current estimator 306 communicates or provides the estimated current 304 to the error amplifier voltage clamp 308 (e.g., using a current that flows to or from the current replicator 406).

The error amplifier voltage clamp 308 includes a voltage pulling device 408, a difference determiner 410, and a current source 412. The current source 412 produces a regulation current 414. The current source 412 is designed to generate the regulation current 414 such that the regulation current 414 reproduces the regulator current 302 that flows within the buffer 404 while the voltage regulator 204 is operating in accordance with at least one regulation parameter. Operation is within a regulation parameter if, for instance, a voltage level of the regulator output voltage 226 is within some threshold (e.g., 1%, 5%, or 10%) of the specified voltage output for the voltage regulation circuitry 104. The current source 412 provides the regulation current 414 to the difference determiner 410.

The difference determiner 410 receives the regulation current 414 from the current source 412, and the current replicator 406 of the current estimator 306 communicates the estimated current 304 to the difference determiner 410. Based on the estimated current 304 and the regulation current 414, the difference determiner 410 produces a current difference indicator 416. The current difference indicator 416 represents a difference of current levels between the regulation current 414, which corresponds to the desired current level for the regulator current 302, and the estimated current 304, which corresponds to a contemporaneous current level of the regulator current 302.

The difference determiner 410 can be realized using at least one active circuit device, at least one passive circuit device, at least one other structural aspect or component of a circuit, some combination thereof, and so forth. In some example implementations, the difference determiner 410 is realized as a node of a circuit, such as a current-summing node with three associated branches that terminate at the current-summing node. Examples of a node-based implementation for the difference determiner 410 are described below with reference to FIGS. 6-1 to 6-3 and 7-1 to 7-3. In such a node-based implementation, the current difference indicator 416 can be realized as a current level flowing to (or from) the voltage pulling device 408. Thus, the difference determiner 410 provides the current difference indicator 416 to the voltage pulling device 408.

The voltage pulling device 408 receives the current difference indicator 416 from the difference determiner 410. Based on the current difference indicator 416, the voltage pulling device 408 adjusts (e.g., pulls up or down) the error amplifier output voltage 224 at the error amplifier output node 214 of the error amplifier 206. The voltage pulling device 408 can be realized using at least one active circuit device, at least one passive circuit device, at least one other structural aspect or component of a circuit, some combination thereof, and so forth. In some example implementations, the voltage pulling device 408 is realized as a transistor. Examples of a transistor-based implementation for the voltage pulling device 408 are described below with reference to FIGS. 6-1 to 6-3 and 7-1 to 7-3. The voltage pulling device 408 is coupled to the error amplifier output node 214 via a voltage pulling coupling 418. Thus, using the voltage pulling coupling 418, the voltage pulling device 408 adjusts a voltage level of the error amplifier output voltage 224 up or down based on the current difference indicator 416.

For example, if the error amplifier output voltage 224 is below a voltage level suitable to drive the output transistor 208 to have a specified regulator output voltage 226, the voltage pulling device 408 pulls the error amplifier output voltage 224 up (e.g., increases the error amplifier output voltage 224). This voltage pulling (up or down) facilitates a maintenance of (e.g., accelerates a restoration of) the regulator output voltage 226 to an in-regulation voltage level and therefore eventually causes the regulator current 302 to return to a current level that flows if the voltage regulator 204 is operating in regulation. With the regulator current 302 returned to a current level that flows for an in-regulation condition, the current replicator 406 replicates the in-regulation regulator current 302 such that the estimated current 304 is also returned to a current level that corresponds to being in-regulation. Consequently, the difference determiner 410 obtains two substantially equal current levels and outputs a current difference indicator 416 having a negligible level. Based on this negligible level for the current difference indicator 416, the voltage pulling device 408 ceases adjusting the error amplifier output voltage 224. Without the voltage pulling device 408 actively adjusting the error amplifier output voltage 224 up or down, the voltage regulator 204 is permitted to continue operating in regulation without being appreciably impacted by the current-controlled clamp 232, at least until the load current 230 (of FIG. 2) changes again.

Figure 5:
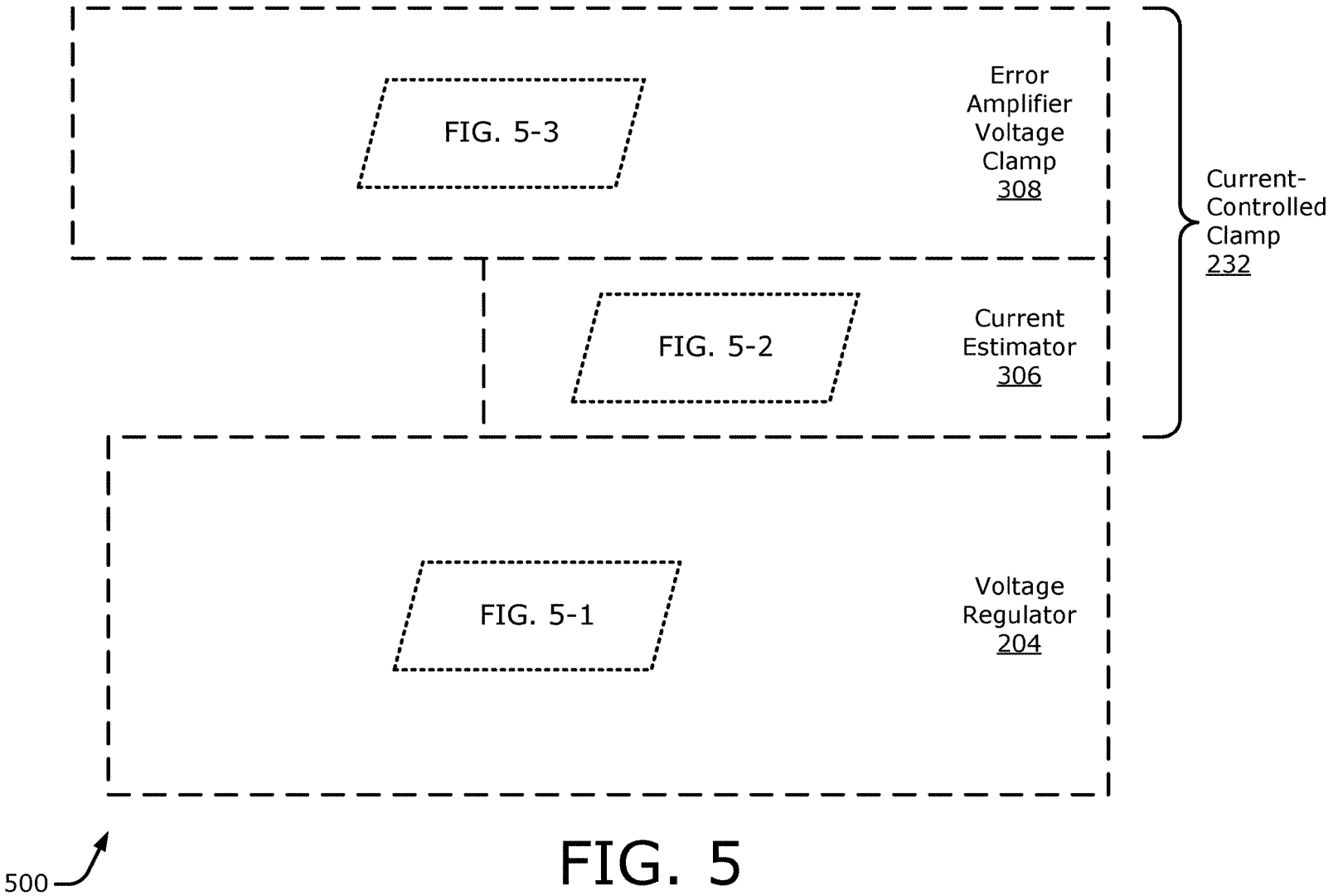
FIG. 5 illustrates a high-level overview of an interrelationship among FIGS. 5-1, 5-2, and 5-3 the jointly depict an example of voltage regulation circuitry.
Figures 1, 5:
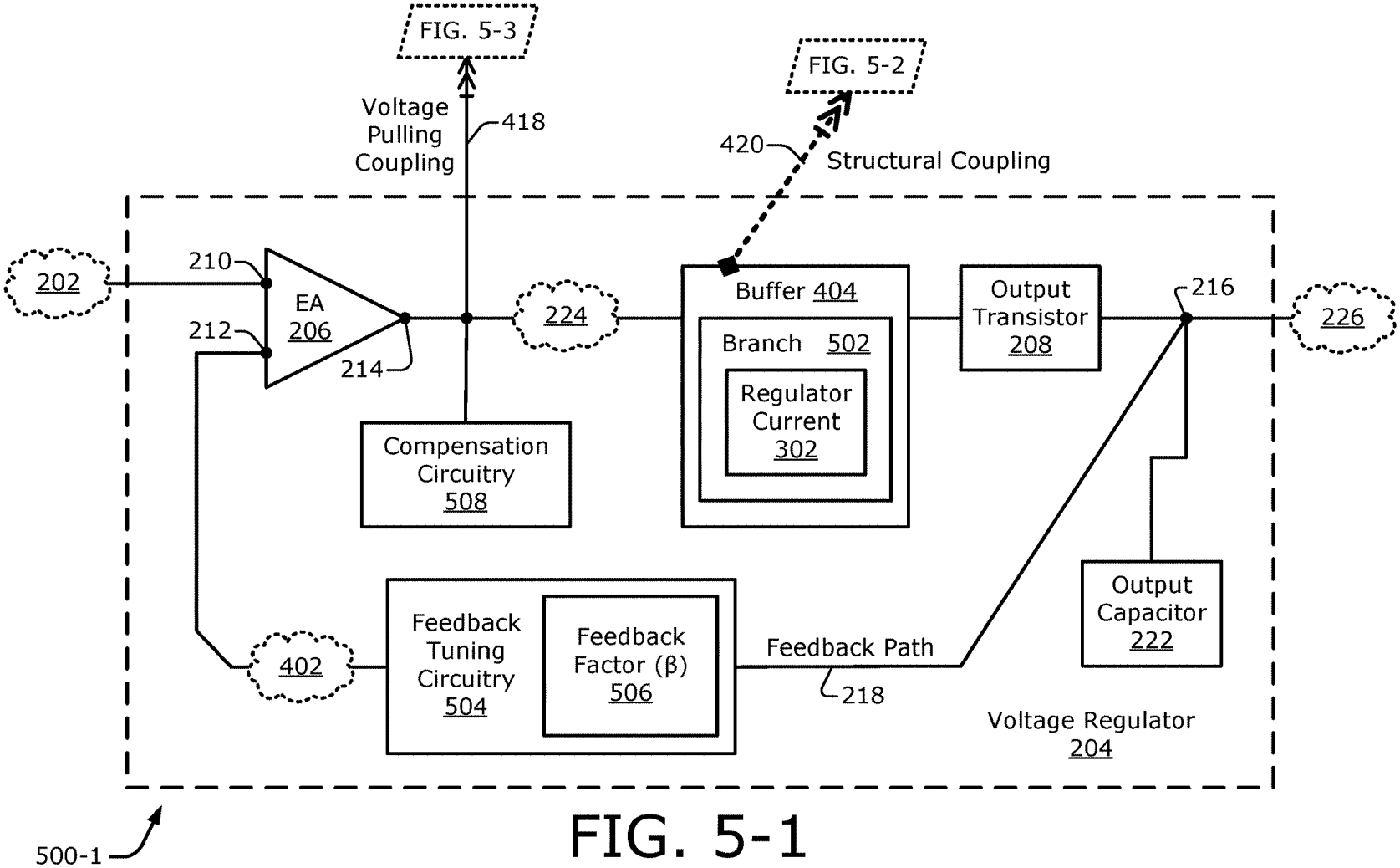
Figures 2, 5:
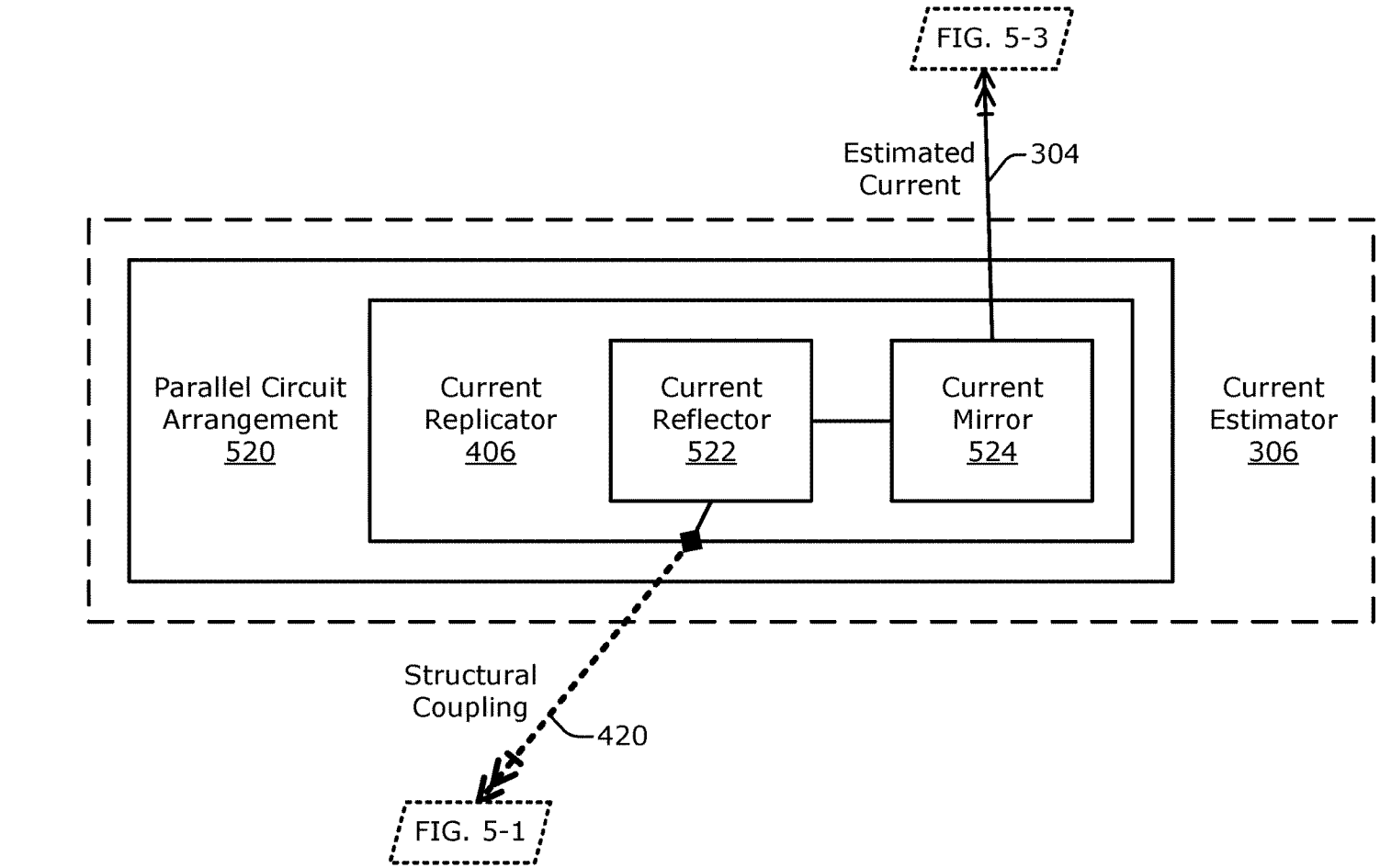
Figures 3, 5:
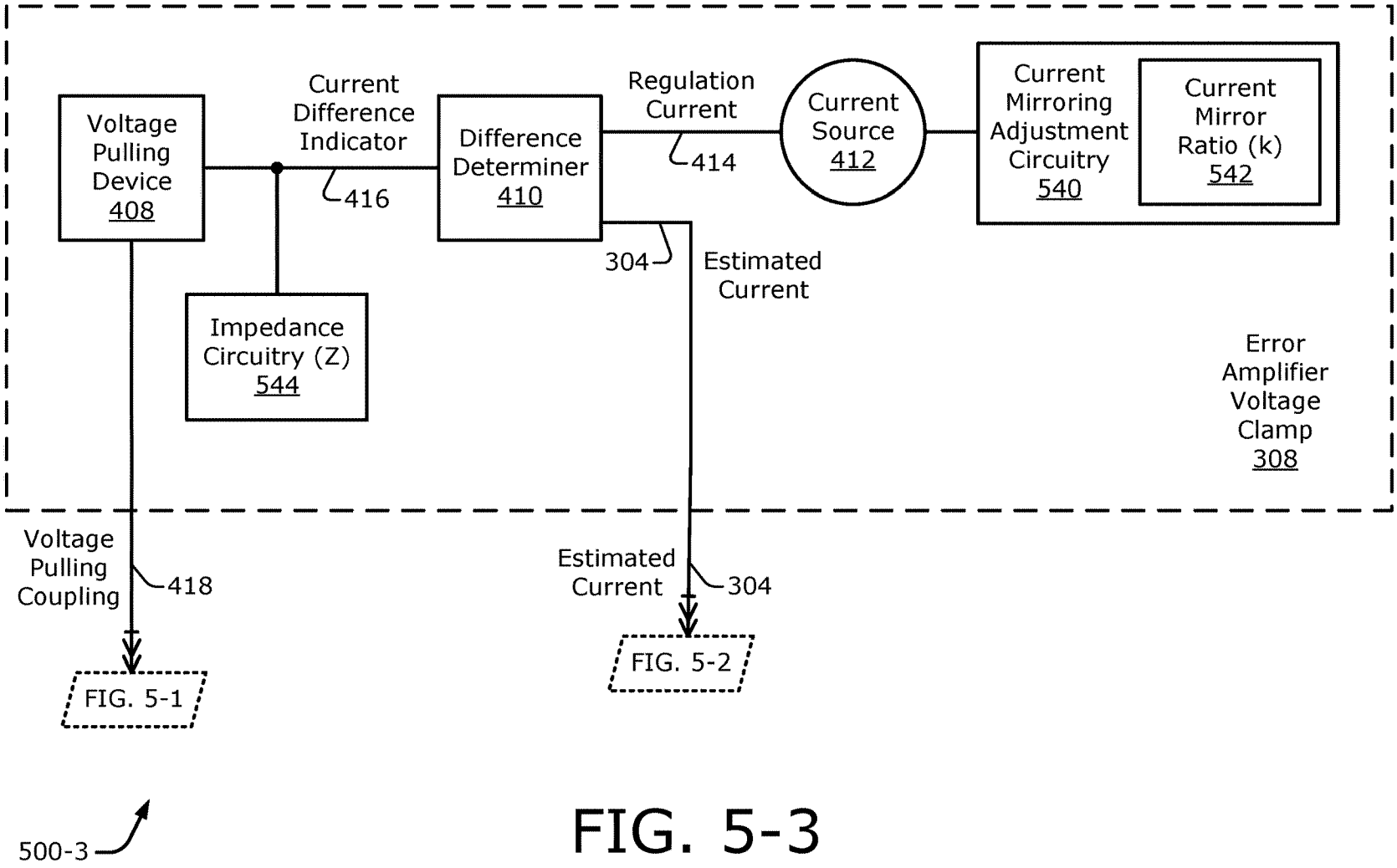

FIG. 5 illustrates generally at 500 a high-level overview of an interrelationship among FIGS. 5-1, 5-2, and 5-3 that jointly depict an example of voltage regulation circuitry 104. An example voltage regulator 204 is depicted in FIG. 5-1. An example current estimator 306 is depicted in FIG. 5-2. And an example error amplifier voltage clamp 308 is depicted in FIG. 5-3. As compared to the portions of the voltage regulation circuitry 104 as illustrated in FIG. 4, each of the portions in FIGS. 5-1 to 5-3 illustrate additional circuitry or functionality, which are described below.

FIG. 5-1 illustrates generally at 500-1 an example voltage regulator 204 of the voltage regulation circuitry 104. The voltage regulator 204 includes the error amplifier 206 and the output transistor 208, which provides the regulator output voltage 226 at the regulator output node 216. Starting at the regulator output node 216 and moving clockwise around the regulator feedback system, the output capacitor 222 is depicted as being coupled to the regulator output node 216. Feedback tuning circuitry 504 is coupled along the feedback path 218. The feedback tuning circuitry 504 adjusts the regulator output voltage 226 to produce the feedback voltage 402 in accordance with the feedback factor 506 (13).

Compensation circuitry 508 is included in the regulator feedback system of the voltage regulator 204 to stabilize the feedback functionality. As shown, the compensation circuitry 508 is coupled to the error amplifier output node 214 of the error amplifier 206. However, the compensation circuitry 508 can alternatively be coupled to another part of the feedback system of the voltage regulator 204. As part of the buffer 404, at least one branch 502 is also shown. The branch 502 includes a circuit device, such as a branch transistor; an interconnect, such as a metallic pathway; or some combination thereof that is present within the buffer 404. In operation, the at least one regulator current 302 flows through the at least one branch 502 of the buffer 404 for the output transistor 208.

Figures 1, 6:
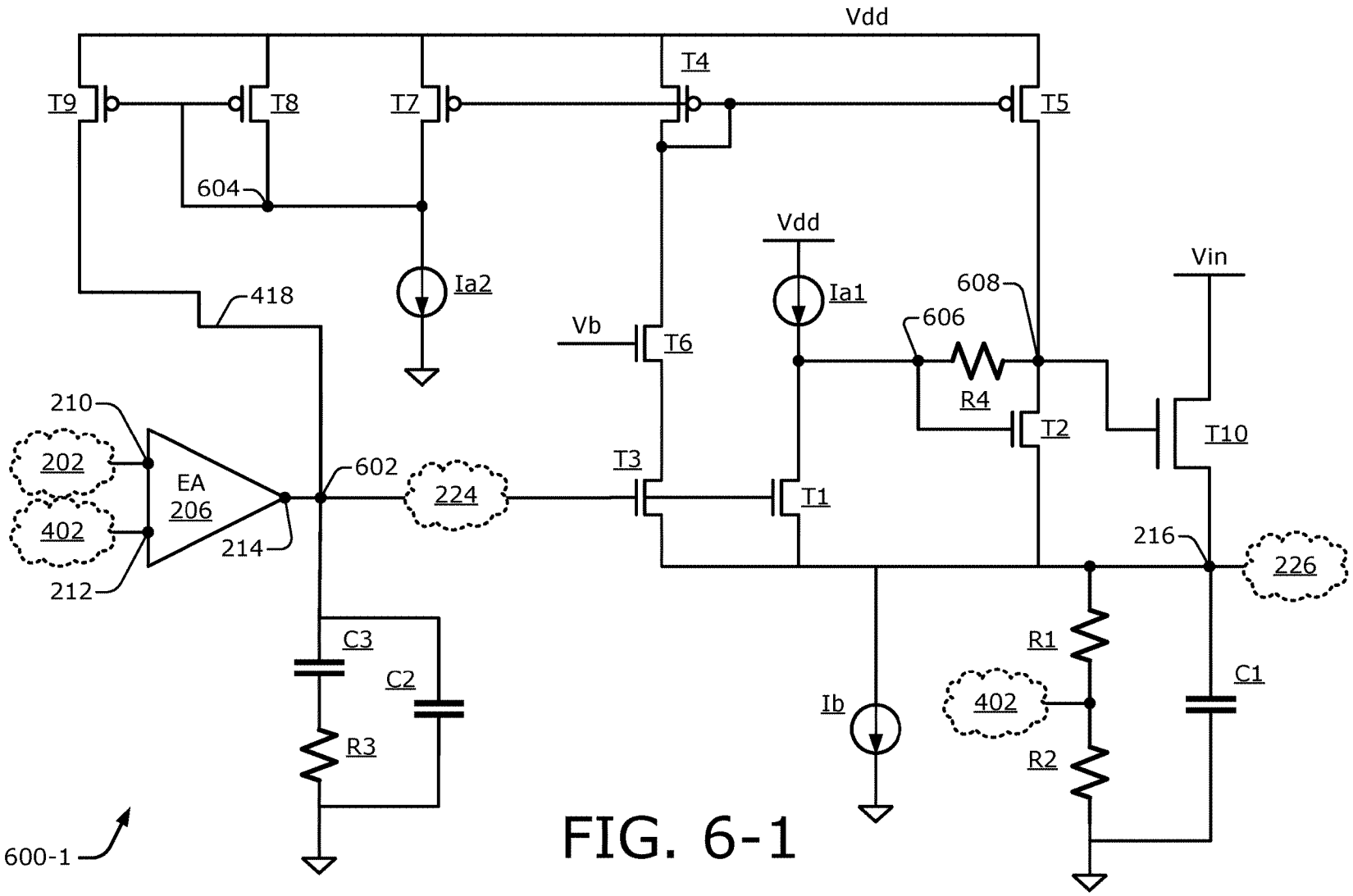
Figures 2, 6:
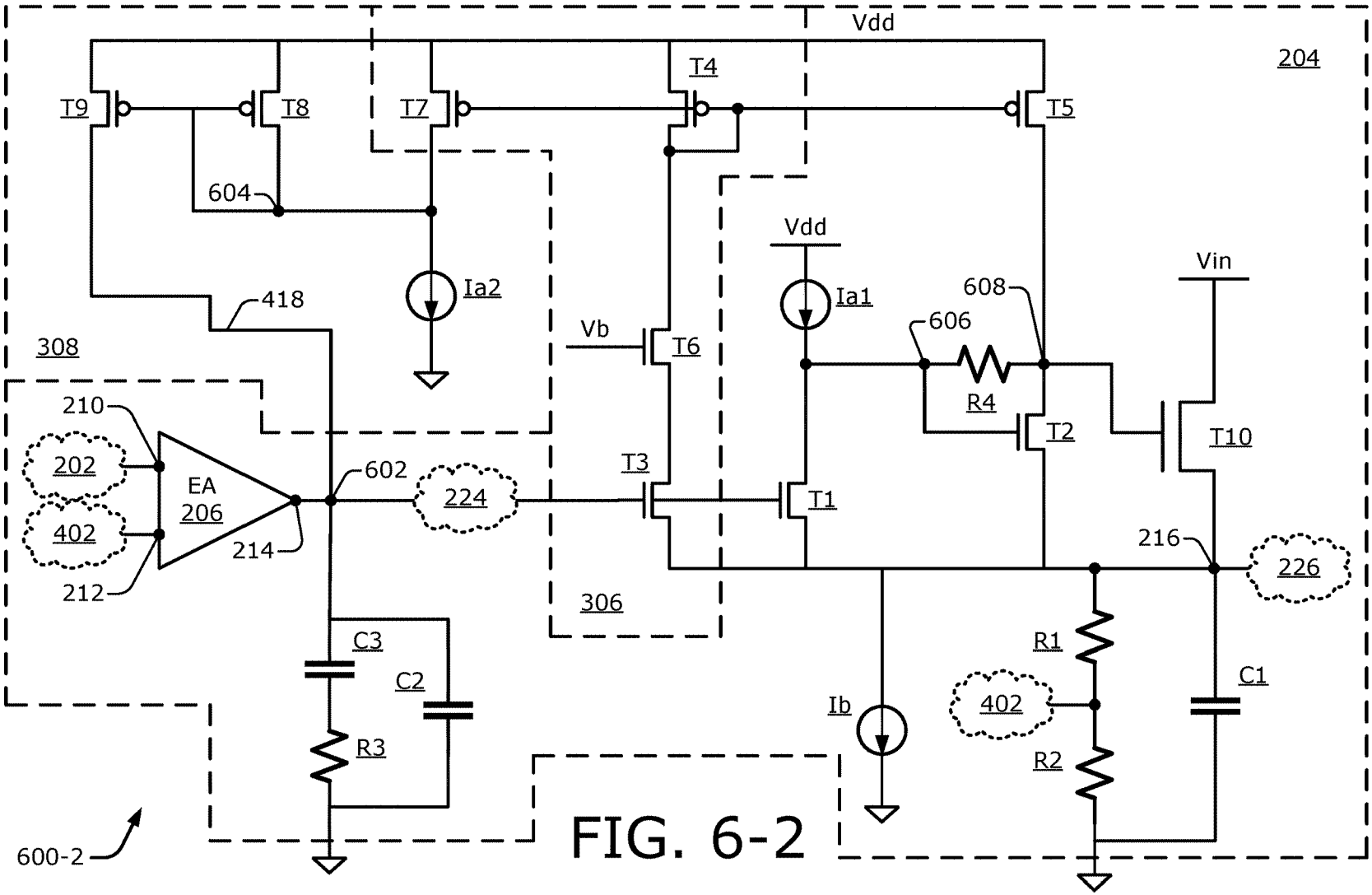
Figures 3, 6:
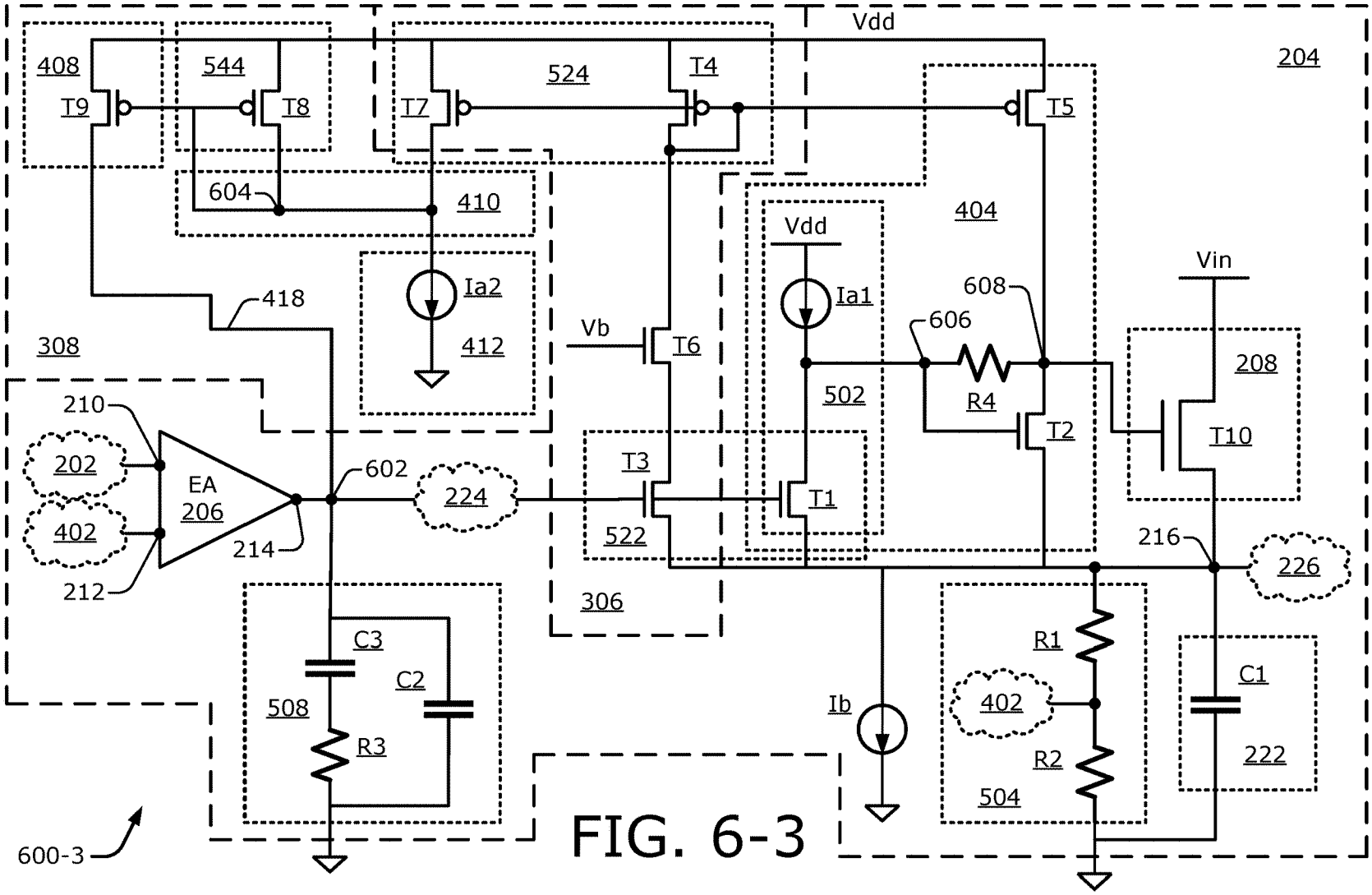
Figures 1, 7:
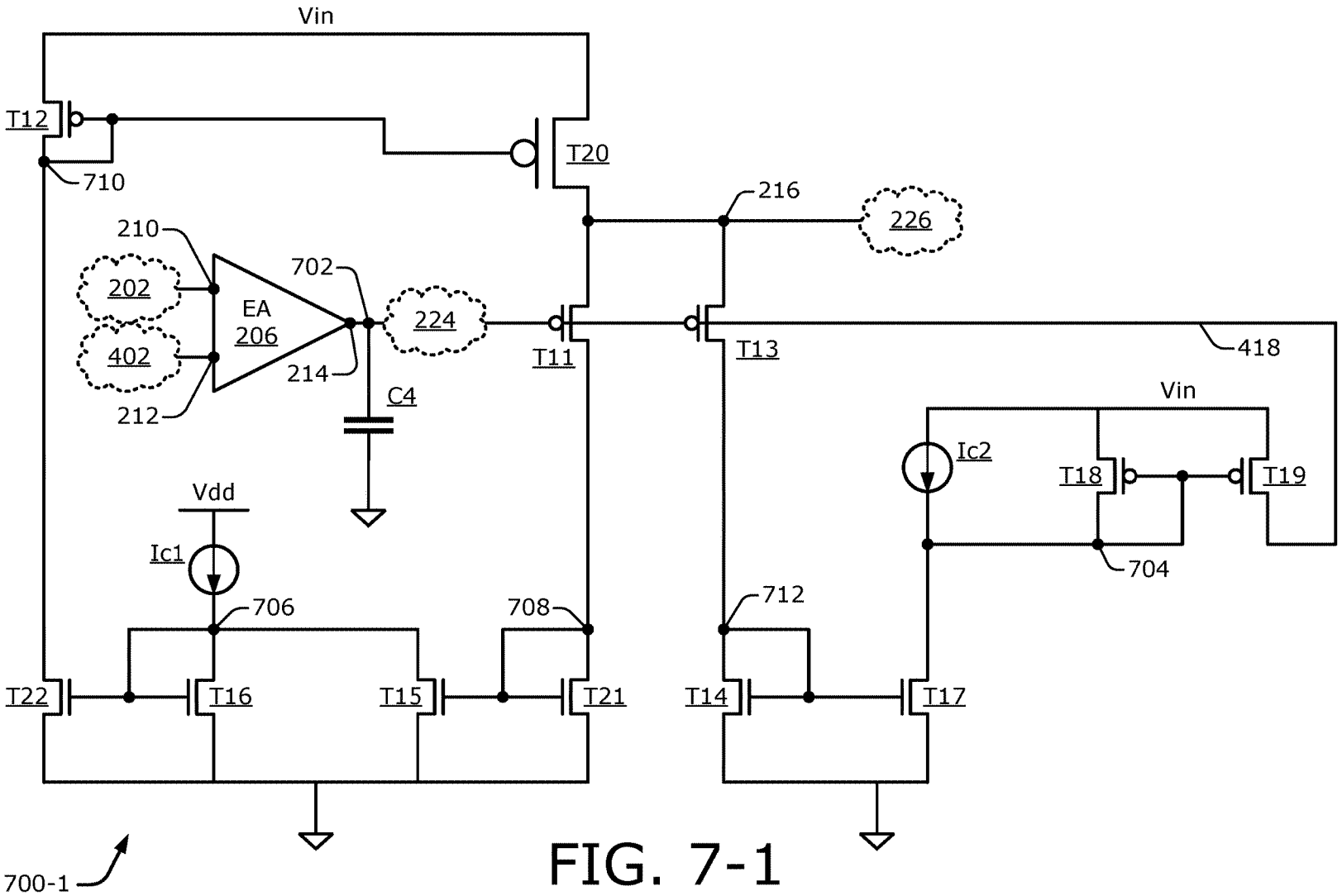
Figures 2, 7:
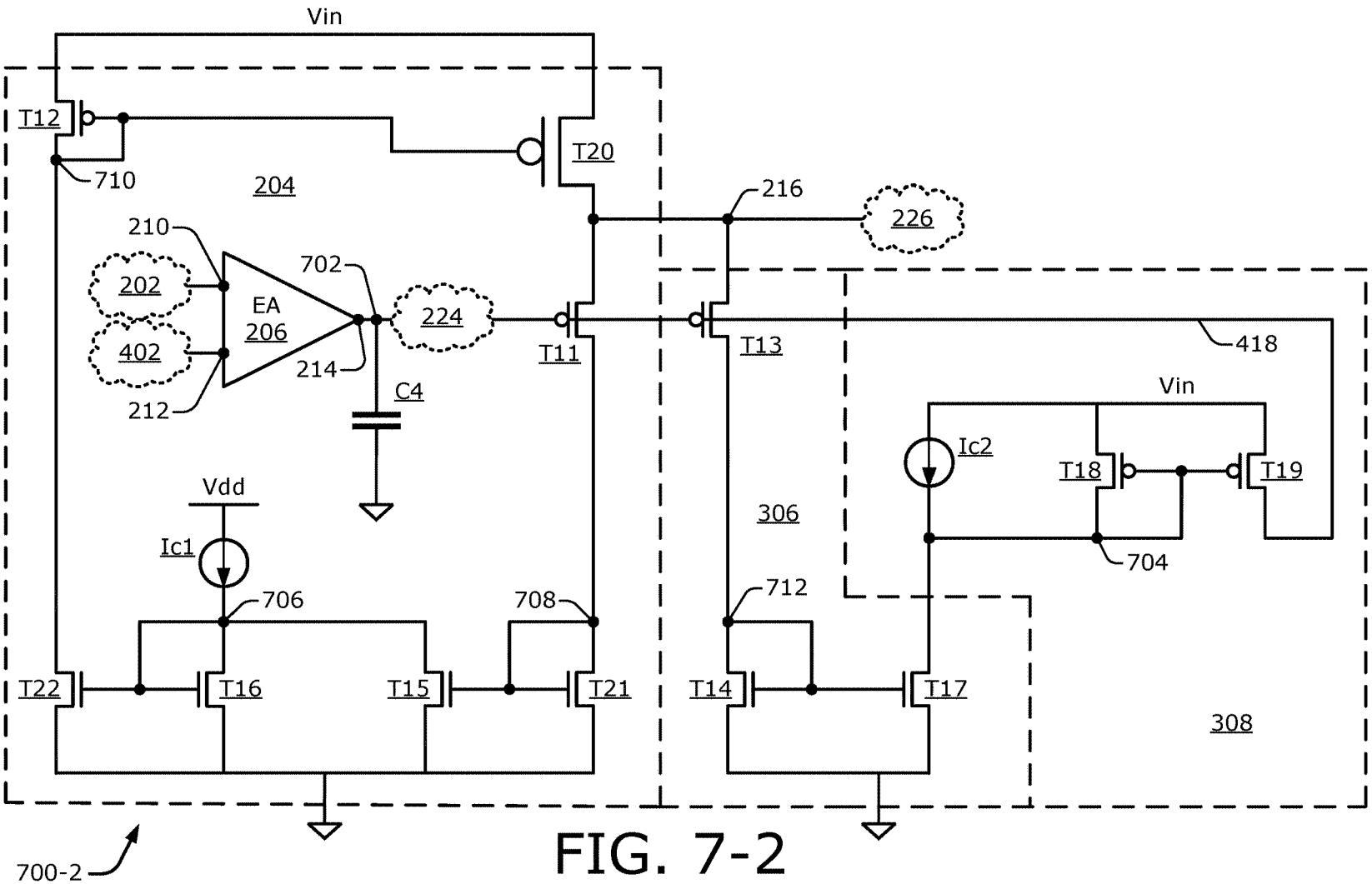
Figures 3, 7:
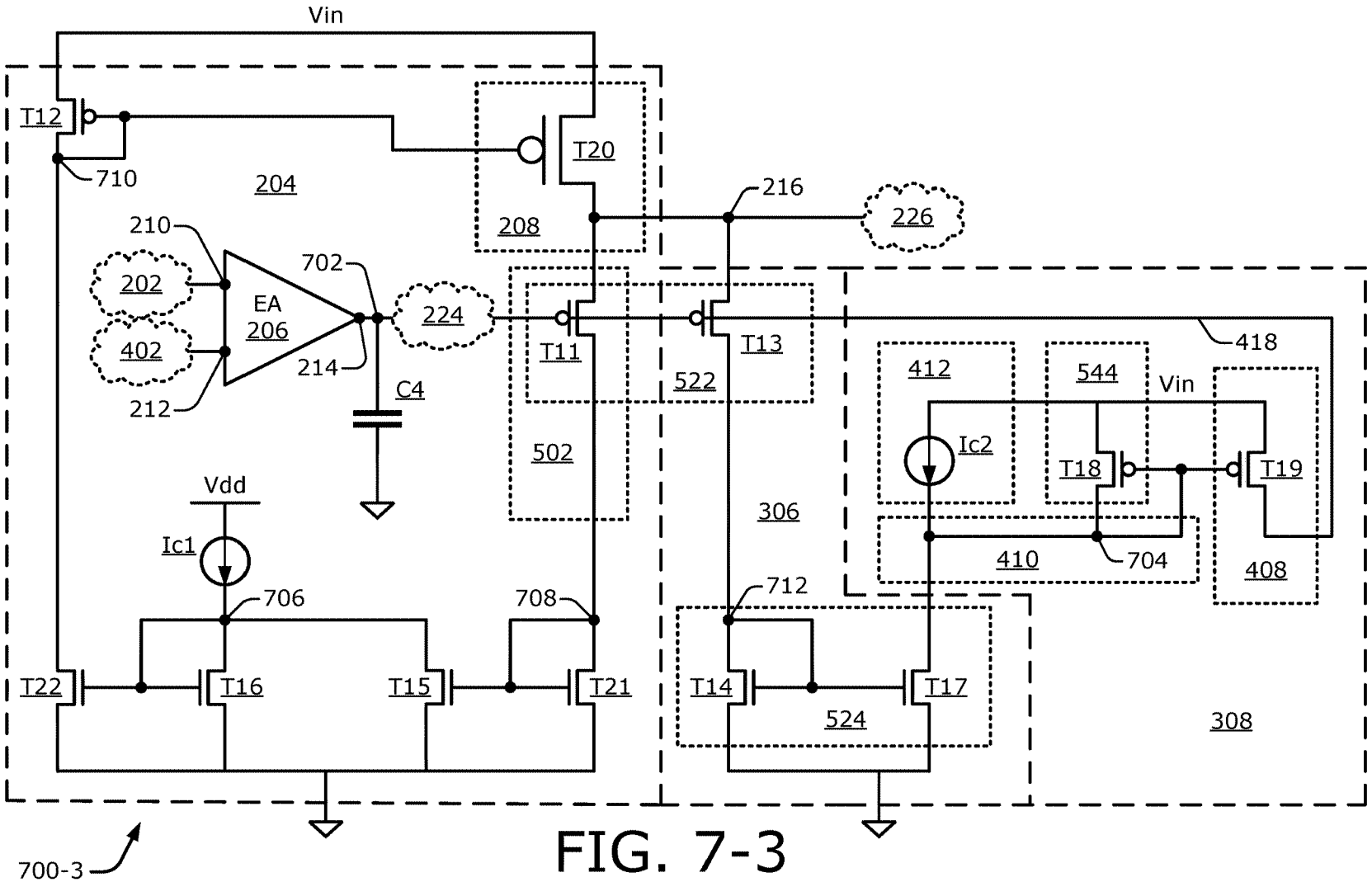

Example implementations of the feedback tuning circuitry 504, the compensation circuitry 508, and the branch 502 are illustrated at the device level in FIGS. 6-3 and 7-3. As indicated in FIG. 5-1, the illustration of the voltage pulling coupling 418 is continued in FIG. 5-3. Also, the illustration of the structural coupling 420 is continued in FIG. 5-2.

FIG. 5-2 illustrates generally at 500-2 an example current estimator 306 of the voltage regulation circuitry 104. As indicated, the illustrated structural coupling 420 extends to FIG. 5-1. The current estimator 306 includes a parallel circuit arrangement 520. As shown, the parallel circuit arrangement 520 includes at least one current replicator 406, and the current replicator 406 includes at least one current reflector 522 and at least one current mirror 524. Thus, the parallel circuit arrangement 520 includes one or more circuit components, such as a reflector transistor (e.g., as part of the current reflector 522) or a mirror transistor (e.g., as part of the current mirror 524), that are coupled in parallel with one or more corresponding circuit components of the branch 502, such as a branch transistor (not shown in FIG. 5-2), of the buffer 404 of the voltage regulator 204, which is depicted in FIG. 5-1. The components of the parallel circuit arrangement 520 are designed to have circuit characteristics that are comparable to those components of the buffer 404 that establish the regulator current 302 within the branch 502. Although not explicitly shown in FIGS. 5 through 5-3, one or more parts of the parallel circuit arrangement 520 of the current estimator 306 can extend into the voltage regulator 204 or the error amplifier voltage clamp 308.

For example, comparable voltage supply levels, voltage control levels, transistor sizes, transistor electrical characteristics, interconnections, and so forth are employed so as cause the estimated current 304 to have a current magnitude that is substantially similar to that of the regulator current 302. A current magnitude of the estimated current 304 can be within, for instance, a current threshold (e.g., 1%, 5%, 10%, or 20%) of a current magnitude of the regulator current 302. Example implementations of the parallel circuit arrangement 520 are described below with reference to FIGS. 6-1 to 6-3 and 7-1 to 7-3, which also depict example implementations of the current reflector 522 and the current mirror 524. As indicated in FIG. 5-2, the estimated current 304 can be communicated to or provided to the error amplifier voltage clamp 308 of FIG. 5-3.

FIG. 5-3 illustrates generally at 500-3 an example error amplifier voltage clamp 308 of the voltage regulation circuitry 104. As indicated in FIG. 5-3, the estimated current 304 is communicated between the current estimator 306 of FIG. 5-2 and the error amplifier voltage clamp 308. Also, the illustrated voltage pulling coupling 418 extends to FIG. 5-1. Current mirroring adjustment circuitry 540 is associated with or coupled to the current source 412. The current mirroring adjustment circuitry 540 works in conjunction with the current source 412 to set the current mirror ratio 542 ($k$). The current mirroring adjustment circuitry 540 can be realized using, for instance, transistors of different sizes in the parallel circuit arrangement 520 of the current replicator 406 (of FIG. 5-2). Also, impedance circuitry 544 (Z) is shown coupled to the voltage pulling device 408. Example implementations of the impedance circuitry 544 are illustrated at the device-level in FIGS. 6-3 and 7-3.

FIGS. 6-1 to 6-3 and FIGS. 7-1 to 7-3 illustrate example implementations of voltage regulation circuitry 104. FIGS. 6-1, 6-2, and 6-3 are respectively directed to illustrations 600-1, 600-2, and 600-3 that each include an output transistor 208 implemented as an N-type metal-oxide-semiconductor (NMOS) power transistor. In contrast, FIGS. 7-1, 7-2, and 7-3 are respectively directed to illustrations 700-1, 700-2, and 700-3 that each include an output transistor 208 implemented as a P-type metal-oxide-semiconductor (PMOS) power transistor.

FIG. 6-1 illustrates, at a circuit device level, an example implementation of voltage regulation circuitry having an NMOS output transistor. For visual clarity, FIG. 6-1 has a clean appearance with no component overlay. In contrast, FIG. 6-2 illustrates the example implementation of the voltage regulation circuitry having the NMOS output transistor with an overlay of components that are depicted in FIG. 3. These components are demarcated with long-dashed lines. FIG. 6-3 includes the overlay of components from FIG. 6-2 and adds an overlay of components that are depicted in FIGS. 4 to 5-3. These additional components are demarcated with short-dashed lines. By way of example, FIGS. 6-2 and 6-3 both indicate with long-dashed lines a voltage regulator 204, a current estimator 306, and an error amplifier voltage clamp 308. FIG. 6-3 additionally indicates with short-dashed lines a number of other components, such as an output transistor 208, a current replicator 522, a current mirror 524, and a voltage pulling device 408. FIGS. 6-1 to 6-3 are jointly referred to below to describe various aspects.

With reference to FIG. 6-2, the voltage regulator 204 includes an error amplifier 206; capacitors C1, C2, and C3; resistors R1, R2, R3, and R4; current sources Ia1 and Ib; and transistors T1, T2, T5, and T10. The current estimator 306 includes transistors T3, T4, T6, and T7. The error amplifier voltage clamp 308 includes transistors T8, and T9 and a current source Ia2. As illustrated, the transistors T9, T8, T7, T4, and T5 are PMOS transistors. And the transistors T6, T3, T1, T2, and T10 are NMOS transistors. The current source Ia1 can be implemented as a PMOS current source. The current source Ia2 and the current source Ib can each be implemented as an NMOS current sink.

With reference primarily to FIG. 6-2, the error amplifier 206 includes a first input node 210, a second input node 212, and an error amplifier output node 214. The error amplifier output node 214 corresponds to a node 602. The capacitor C3 and the resistor R3 are coupled in series between the node 602 and an equipotential node, which is referred to as ground herein. The capacitor C2 is also coupled between the node 602 and ground so as to be in parallel with the capacitor C3 and the resistor R3. Together, the capacitor C2, the capacitor C3, and the resistor R3 function as an example of compensation circuitry 508 (as indicated in FIG. 6-3) for the regulator feedback system of the voltage regulator 204.

Continuing along the lower portion of FIG. 6-2, the current source Ib is coupled between the regulator output node 216 and ground. The current source Ib provides a bias current for the voltage regulator 204. The resistor R1 and the resistor R2 are coupled in series between the regulator output node 216 and ground. Together, the resistor R1 and the resistor R2 form a voltage divider that provides the feedback voltage 402 for the second input node 212 of the error amplifier 206 based on the regulator output voltage 226 at the regulator output node 216. The resistor R1 and the resistor R2 therefore jointly function as an example of feedback tuning circuitry 504 (as indicated in FIG. 6-3) to institute a feedback factor 506 (13) along the feedback path 218 (of FIG. 5-1). One or both of the resistor R1 or the resistor R2 can be adjustable to implement an adjustable feedback factor 506 ((3). The capacitor C1 is also coupled between the regulator output node 216 and ground. As indicated in FIG. 6-3, the capacitor C1 functions as an example of an output capacitor 222.

Continuing with the voltage regulator 204 in the upper rightward portion of FIG. 6-2, the current source Ia1 is coupled between a supply voltage Vdd and a node 606. The transistor T1 is coupled between the node 606 and the regulator output node 216. A gate of the transistor T1 is coupled to the node 602 of the error amplifier output. The transistor T5 is coupled between the supply voltage Vdd and a node 608. The transistor T2 is coupled between the node 608 and the regulator output node 216. The resistor R4 is coupled between the node 606 and the node 608. A gate of the transistor T2 is also coupled to the node 606. The transistor T10 is coupled between an input voltage Vin and the regulator output node 216 to generate the regulator output voltage 226. A gate of the transistor T10 is coupled to the node 608. As indicated in FIG. 6-3, the transistor T10 functions as an example of an output transistor 208.

The current estimator 306 is demarcated in the upper middle portion of FIG. 6-2. The transistor T4, the transistor T6, and the transistor T3 are coupled in series between the supply voltage Vdd and the regulator output node 216. Specifically, the transistor T4 is coupled to the supply voltage Vdd, and the transistor T3 is coupled to the regulator output node 216. A gate of the transistor T3 is coupled to the node 602 of the error amplifier output. A gate of the transistor T6 is coupled to a bias voltage Vb to enable operation of the current estimator 306. The transistor T7 is coupled between the supply voltage Vdd and a node 604. A gate of the transistor T7 is coupled back to a gate of the transistor T4.

The error amplifier voltage clamp 308 is demarcated in the upper leftward portion of FIG. 6-2. The current source Ia2 is coupled between the node 604 and ground. The transistor T8 is coupled between the supply voltage Vdd and the node 604. A gate of the transistor T8 is coupled the node 604 to enable the transistor T8 to function as a diode-connected transistor. A gate of the transistor T9 is also coupled to the node 604. The transistor T9 is coupled between the supply voltage Vdd and the node 602 for the error amplifier output via the voltage pulling coupling 418.

With reference primarily to FIG. 6-3, the voltage regulator 204 includes an example of a buffer 404. The buffer 404 includes the current source Ia1; the resistor R4; and the transistors T1, T2, and T5. The current source Ia1 and the transistor T1 function as an example of a branch 502 of the buffer 404. Thus, a current flowing through the transistor T1 alone or in conjunction with a current of the resistor R4 (or the transistor T2) corresponds to an example of at least one regulator current 302 that flows through the at least one branch 502. As shown, the current source Ia1 biases the branch 502 with a fixed current Ia1. In this sense, the transistor T1 functions as an example of a branch transistor of the voltage regulator 204.

The transistors T1 and T3 function as an example of a current replicator 522. The transistor T3 functions as an example of a replicator transistor of the current replicator 522. Here, the current replicator 522 extends across a logical boundary between the voltage regulator 204 and the current estimator 306. The column including the transistor T4, the transistor T6, and the transistor T3, along with at least part of the column that includes the transistor T7, correspond to an example of a parallel circuit arrangement 520 (of FIG. 5-2) with respect to at least the circuitry column having the current source Ia1 and the transistor T1. The transistor T3 and the transistor T1 are both coupled between the supply voltage Vdd and the regulator output node 216 and are both controlled at a respective gate terminal thereof by the error amplifier output voltage 224 at the node 602. However, neither transistor has a gate coupled to another terminal thereof; hence, the transistors T1 and T3 do not form a traditional current mirror. Regardless, the transistor T1 and the transistor T3 can form the current reflector 522 because their source terminals are coupled to a same node, the regulator output node 216, and their gate terminals are coupled to a same node, the node 602. By using transistors of substantially similar sizes and electrical characteristics, the transistor T3 can reflect the current flowing through the transistor T1 (e.g., the regulator current 302) sufficiently so as to eventually produce the estimated current 304 (not shown in FIG. 6-3), as described below with reference to the current mirror 524.

The current reflector 522 operates with the current mirror 524 to replicate the current flowing through the transistor T1 (e.g., the regulator current 302) for the error amplifier voltage clamp 308. The transistors T4 and T7 function as an example of a current mirror 524 to mirror a current in the transistor T4 over to the transistor T7. The transistor T7 therefore functions as an example of a mirror transistor of the current mirror 524. The current replication is effective because the reflected current in the transistor T3 also flows through the transistor T4, which is mirrored over to the transistor T7 with the current mirror 524. Thus, the current flowing within the transistor T7 is proportional to that flowing within the transistor T1. In other words, the current reflector 522 and the current mirror 524 operate jointly as the current replicator 406 (e.g., of FIGS. 4 and 5-2) to replicate the at least one regulator current 302 flowing through the transistor T1 to produce the estimated current 304 flowing within the transistor T7. In these manners, the transistor T3, the transistor T4, and the transistor T7 can function to produce the estimated current 304 and communicate the estimated current 304 to the error amplifier voltage clamp 308.

Within the error amplifier voltage clamp 308, the current source Ia2 functions as an example of a current source 412. Thus, a current Ia2 provided by the current source Ia2 corresponds to an example of the regulation current 414. The node 604 functions as an example of a difference determiner 410. The transistor T8 functions as an example of impedance circuitry 544, and the transistor T9 functions as an example of a voltage pulling device 408. The current flowing into the gate or drain or both the gate and the drain of the transistor T8, or the voltage resulting therefrom, or the current flowing away from the gate or drain or both the gate and the drain of the transistor T8, or the voltage resulting therefrom, therefore corresponds to an example of the current difference indicator 416 (of FIGS. 4 and 5-3), which is also applied to the gate of the transistor T9. In this manner, the current difference indicator 416 can control operation of the voltage pulling device 408, which is implemented as the transistor T9 here.

Example operations are described below primarily at the transistor level. In one situation, the error amplifier output voltage 224 at the node 602 is dropping toward ground, and the error amplifier voltage clamp 308 is configured to pull the voltage back up. This node 602 is coupled to the gate of the transistor T1. As a result, as the voltage drops at the node 602, the current flowing through the transistor T1 decreases. This decreasing current level is reflected in the transistor T3, conducted to the transistor T4, and then mirrored over to the transistor T7. Consequently, a current level of the current flowing through the transistor T7 decreases. The current of the transistor T7 is now lower than the current Ia2, so a voltage level of the node 604 drops because the current through T8 increases. This voltage drop at the node 604 turns the transistor T9 on more strongly. As the transistor T9 is turned on at increasingly higher levels, the transistor T9 uses the voltage pulling coupling 418 to adjust the voltage at the node 602 (e.g., to pull up) with greater strength so as to return the voltage level of the error amplifier output voltage 224 at the error amplifier output node 214 to a regulation level.

In another scenario, the error amplifier voltage clamp 308 is to cease pulling with a force sufficient to affect the error amplifier output node 214 once the error amplifier 206 is operating in regulation. For a steady-state nominal condition, the transistor T1 conducts the current Ia1. This current level is reflected to the transistor T3, conducted to the transistor T4, and then mirrored over to the transistor T7. Thus, the transistor T7 also conducts a current of Ia1. The current Ia2 is selected to have a current level that is slightly smaller than that of the current Ia1. Consequently, the node 604 is pulling toward the supply voltage Vdd. This higher voltage applied to the gate terminal of the transistor T9 causes the transistor T9 to become more resistive (and can turn off the transistor T9 at some voltage level). The transistor T9 therefore reduces an amount by which it is pulling up on the error amplifier output at the node 602 via the voltage pulling coupling 418. In this manner, the error amplifier voltage clamp 308 reduces a pulling force (and can stop pulling at some point) during a nominal operating condition.

In yet another scenario, a voltage level of the error amplifier output voltage 224 of the error amplifier output node 214 is above a nominal level. In this scenario, such as if the regulator output voltage 226 drops below regulation, the current flowing through the transistor T1 is even higher than if the error amplifier 206 is operating in regulation. Based on the chain of current replication (e.g., current reflecting and then current mirroring in the example of FIGS. 6-1 to 6-2), the current flowing through the transistor T7 is likewise higher than the nominal scenario. Thus, the transistor T9 is shut off even more strongly as compared to the nominal case such that the voltage pulling device 408 does not pull up or down on the error amplifier output node 214.

FIG. 7-1 illustrates, at a circuit device level, an example implementation of voltage regulation circuitry having a PMOS output transistor. For visual clarity, FIG. 7-1 has a clean appearance with no component overlay. In contrast, FIG. 7-2 illustrates the example implementation of the voltage regulation circuitry having the PMOS output transistor with an overlay of components that are depicted in FIG. 3. These components are demarcated with long-dashed lines. FIG. 7-3 includes the overlay of components from FIG. 7-2 and adds an overlay of components that are depicted in FIGS. 4 to 5-3. These components are demarcated with short-dashed lines. By way of example, FIGS. 7-2 and 7-3 both indicate with long-dashed lines from left to right: a voltage regulator 204, a current estimator 306, and an error amplifier voltage clamp 308. FIG. 7-3 additionally indicates with short-dashed lines a number of other components, such as an output transistor 208, a current replicator 522, a current mirror 524, and a voltage pulling device 408. FIGS. 7-1 to 7-3 are jointly referred to below to describe various aspects.

With reference to FIG. 7-2, the voltage regulator 204 includes an error amplifier 206; a capacitor C4; a current source Ic1; and transistors T11, T12, T15, T16, T20, T21, and T22. The current estimator 306 includes transistors T13, T14, and T17. The error amplifier voltage clamp 308 includes transistors T18 and T19 and a current source Ic2. As illustrated, the transistors T12, T20, T11, T13, T18, and T19 are PMOS transistors. And the transistors T22, T16, T15, T21, T14, and T17 are NMOS transistors. The current source Ic1 and the current source Ic2 can each be implemented as a PMOS current source.

With reference primarily to FIG. 7-2, the error amplifier 206 includes a first input node 210, a second input node 212, and an error amplifier output node 214. The error amplifier output node 214 corresponds to a node 702. The capacitor C4 is coupled between the node 702 and an equipotential node, which is referred to as ground herein. As part of the voltage regulator 204, the transistor T20 is coupled between the input voltage Vin and the regulator output node 216. The transistor T11 is coupled between the regulator output node 216 and a node 708. The transistor T21 is coupled between the node 708 and ground. A gate of the transistor T21 is also coupled to the node 708.

The current source Ic1 is coupled between a supply voltage Vdd and a node 706. The transistor T15 and the transistor T16 are both coupled between the node 706 and ground. A gate of the transistor T16 and a gate of the transistor T22 are also coupled to the node 706. The transistor T22 is coupled between a node 710 and ground. The transistor T12 is coupled between the input voltage Vin and the node 710. A gate of the transistor T12 and a gate of the transistor T20 are also coupled to the node 710.

Continuing with FIG. 7-2 at the current estimator 306, the transistor T13 is coupled between the regulator output node 216 and a node 712. The transistor T14 is coupled between the node 712 and ground. A gate of the transistor T14 is also coupled to the node 712. The transistor T17 is coupled between a node 704 and ground, with a gate of the transistor T17 coupled to the node 712. At the error amplifier voltage clamp 308, the current source Ic2 is coupled between the input voltage Vin and the node 704. The transistor T18 is coupled between the input voltage Vin and the node 704, with a gate of the transistor T18 also coupled to the node 704. The transistor T19 is coupled between the input voltage Vin and the node 702 for the error amplifier output via the voltage pulling coupling 418, with a gate terminal of the transistor T19 being coupled to the node 704. The node 702 corresponds to the error amplifier output voltage 224 of the error amplifier 206. The node 702 is also coupled to a gate of the transistor T11 and a gate of the transistor T13.

With reference primarily to FIG. 7-3, the transistor T20 is indicated as an example of an output transistor 208. The buffer 404 of the voltage regulator 204 is not explicitly indicated for clarity. However, the buffer 404 includes the transistor T12, the transistor T22, the transistor T16, the transistor T15, the transistor T21, and the transistor T11. Further, the transistor T11 functions as an example of a branch 502 of the buffer 404. In this sense, the transistor T11 functions as an example of a branch transistor of the voltage regulator 204. Thus, a current flowing through the transistor T11 corresponds to an example of at least one regulator current 302 that flows through the at least one branch 502. As shown, the current source Ic1 biases the branch 502 with a fixed current Ic1.

The transistor T11 and the transistor T13 function as an example of a current replicator 522. The transistor T13 functions as an example of a replicator transistor of the current replicator 522. Here, the current replicator 522 straddles a logical boundary between the voltage regulator 204 and the current estimator 306. The column including the transistor T13 and the transistor T14, along with part of the column that includes the transistor T17, correspond to an example of a parallel circuit arrangement 520 (not explicitly indicated in FIG. 7-3) with respect to at least the circuitry column including the transistor T20, the transistor T11, and the transistor T21. The transistor T11 and the transistor T13 are both coupled between the regulator output node 216 and ground and are both controlled at a respective gate terminal thereof by the error amplifier output voltage 224 at the node 702. However, neither transistor has a gate coupled to another terminal thereof; hence, the transistors T11 and T13 do not form a traditional current mirror. Regardless, the transistor T11 and the transistor T13 can form the current reflector 522 because their source terminals are coupled to a same node, the regulator output node 216, and their gate terminals are coupled to a same node, the node 702. By using transistors of substantially similar sizes and electrical characteristics, the transistor T13 can reflect the current flowing through the transistor T11 (e.g., the regulator current 302) sufficiently so as to eventually produce the estimated current 304 (not shown), as described below with reference to the current mirror 524.

The current reflector 522 operates with the current mirror 524 to replicate the current flowing through the transistor T11 (e.g., the regulator current 302) for the error amplifier voltage clamp 308. The transistors T14 and T17 function as an example of a current mirror 524 to mirror a current in the transistor T14 over to the transistor T17. The transistor T17 therefore functions as an example of a mirror transistor of the current mirror 524. The current replication is effective because the current in the transistor T13 also flows through the transistor T14, which is mirrored over to the transistor T17 by the current mirror 524. Thus, the current flowing within transistor T17 is proportional to that flowing within transistor T11. In other words, the current reflector 522 and the current mirror 524 operate jointly as the current replicator 406 (e.g., of FIGS. 4 and 5-2) to replicate the at least one regulator current 302 flowing through the transistor T11 to produce the estimated current 304 flowing within the transistor T17. In these manners, the transistor T13, the transistor T14, and the transistor T17 can function to produce the estimated current 304 and communicate the estimated current 304 to the error amplifier voltage clamp 308.

Within the error amplifier voltage clamp 308, the current source Ic2 functions as an example of a current source 412. Thus, a current Ic2 provided by the current source Ic2 corresponds to an example of the regulation current 414. The node 704 functions as an example of a difference determiner 410. The transistor T18 functions as an example of impedance circuitry 544, and the transistor T19 functions as an example of a voltage pulling device 408. The current flowing into the gate or drain or both the gate and the drain of the transistor T18, or the voltage resulting therefrom, or the current flowing away from the gate or drain or both the gate and the drain of the transistor T18, or the voltage resulting therefrom, therefore corresponds to an example of the current difference indicator 416, which is also applied to the gate of the transistor T19. In this manner, the current difference indicator 416 can control operation of the voltage pulling device 408, which is implemented as the transistor T19 here.

An example operation is described below primarily at the transistor level. In a non-regulation scenario in which the regulator output voltage 226 is above a regulation voltage level, the error amplifier output voltage 224 at the node 702 is dropping toward ground, and the error amplifier voltage clamp 308 is to adjust the voltage at the error amplifier output node 214 by pulling the voltage back up. This node 702 is coupled to the gate of the transistor T11, so as the voltage level of the error amplifier output node 214 drops, the current flowing through the transistor T11 increases. This increased current level is reflected in the transistor T13, conducted to the transistor T14, and then mirrored over to the transistor T17. Consequently, a current level of the current flowing through the transistor T17 likewise increases. The current Ic2 is selected to have a current level that is slightly greater than that of the current Ic1. However, the current of the transistor T17 is now greater than the current Ic2, so a voltage level of the node 704 drops. This voltage drop at the node 704 turns the transistor T19 on more strongly. As the transistor T19 is turned on at increasingly higher levels, the transistor T19 uses the voltage pulling coupling 418 to adjust the voltage at the node 702 (e.g., pull up) with greater strength so as to return the voltage level of the error amplifier output node 214 toward a regulation level. For other scenarios, the example PMOS implementation of FIGS. 7-1 to 7-3 operates analogously to the example NMOS implementation of FIGS. 6-1 to 6-3 as described above.

Figure 8:
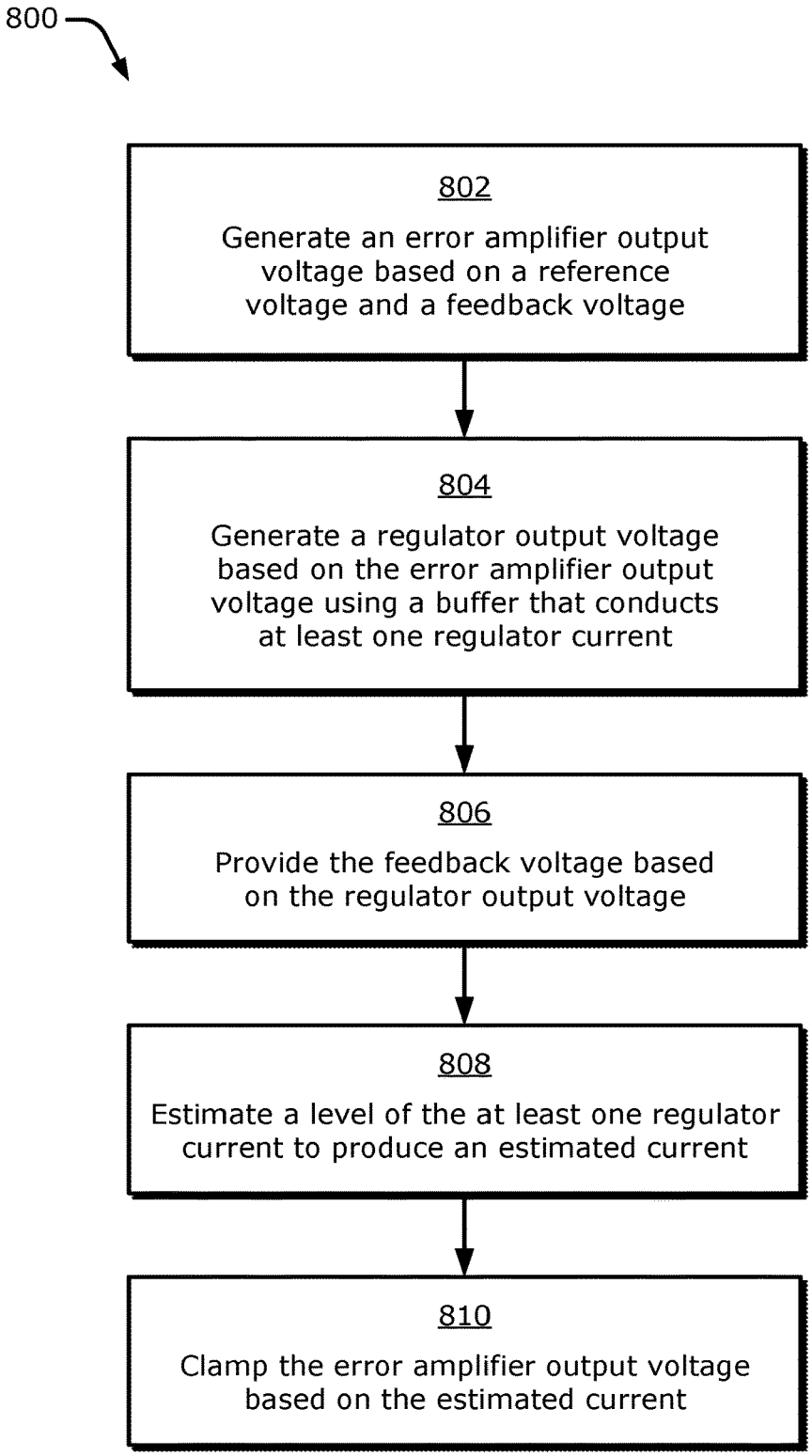
FIG. 8 is a flow diagram illustrating an example process for current-controlled voltage regulation.

FIG. 8 is a flow diagram illustrating an example process 800 for current-controlled voltage regulation. The process 800 is described in the form of a set of blocks 802-810 that specify operations that can be performed. However, operations are not necessarily limited to the order shown in FIG. 8 or described herein, for the operations may be implemented in alternative orders or in fully or partially overlapping manners. Operations represented by the illustrated blocks of the process 800 may be performed by an integrated circuit, such as the integrated circuit 100 of FIG. 1 or the integrated circuit 910 of FIG. 9, which is described below. More specifically, the operations of the process 800 may be performed by the power management integrated circuit 102 of FIG. 1, including the voltage regulation circuitry 104 thereof, or the power management integrated circuit 920 of FIG. 9.

At block 802, an error amplifier output voltage is generated based on a reference voltage and a feedback voltage. For example, an integrated circuit can generate an error amplifier output voltage 224 based on a reference voltage 202 and a feedback voltage 402. An operational amplifier, for instance, of a voltage regulator 204 may amplify a difference between the reference voltage 202 and the feedback voltage 402.

At block 804, a regulator output voltage is generated based on the error amplifier output voltage using a buffer that conducts at least one regulator current. For example, the integrated circuit can generate a regulator output voltage 226 based on the error amplifier output voltage 224 using a buffer 404 that conducts at least one regulator current 302. An output transistor 208 of the voltage regulator 204, which is driven by the buffer 404 having a branch 502 in which the regulator current 302 flows, may provide the regulator output voltage 226 at a regulator output node 216.

At block 806, the feedback voltage is provided based on the regulator output voltage. For example, the integrated circuit can provide the feedback voltage 402 based on the regulator output voltage 226. To do so, a feedback path 218 may route the regulator output voltage 226 through feedback tuning circuitry 504 to produce the feedback voltage 402 at the second input node 212 of the error amplifier 206.

At block 808, a level of the at least one regulator current is estimated to produce an estimated current. For example, the integrated circuit can estimate a level of the at least one regulator current 302 to produce an estimated current 304. For instance, a current mirror 406 of a current estimator 306 may mirror the regulator current 302 flowing through the branch 502 of the buffer 404 of the voltage regulator 204. An example implementation of the estimation at block 808 includes mirroring the level of the at least one regulator current 302 using a parallel circuit arrangement 520 to produce the estimated current 304.

At block 810, the error amplifier output voltage is clamped based on the estimated current. For example, the integrated circuit can clamp the error amplifier output voltage 224 based on the estimated current 304. A voltage pulling device 408 of an error amplifier voltage clamp 308 may pull up or down on the error amplifier output voltage 224 at the error amplifier output node 214 based on the estimated current 304 and a regulation current 414, which is generated to match the regulator current 302 that flows in the branch 502 of the buffer 404 if the voltage regulator 204 is operating in regulation. An example implementation of the pulling at block 810 includes restoring the at least one regulator current 302 to a current level that flows through the buffer 404 if the regulator output voltage 226 is in regulation and maintaining, based on the restoring, the regulator output voltage 226 that occurs responsive to an onset of an increased draw of the load current 230.

Example implementations of the process 800 can further include an operation of determining a current difference indicator 416 based on the estimated current 304 and a regulation current 414, with the voltage pulling including pulling the error amplifier output voltage 224 based on the current difference indicator 416. Implementation of a current-controlled voltage regulation procedure can further include generating the regulation current 414 so as to reproduce a current level of the at least one regulator current 302 that flows if the regulator output voltage 226 is in regulation. An example implementation of the voltage pulling can further include pulling the error amplifier output voltage 224 based on the current difference indicator 416 by coupling the current difference indicator 416 to a gate of a field effect transistor (FET) (e.g., the transistor T9 of FIG. 6-3 or the transistor T19 of FIG. 7-3).

Figure 9:
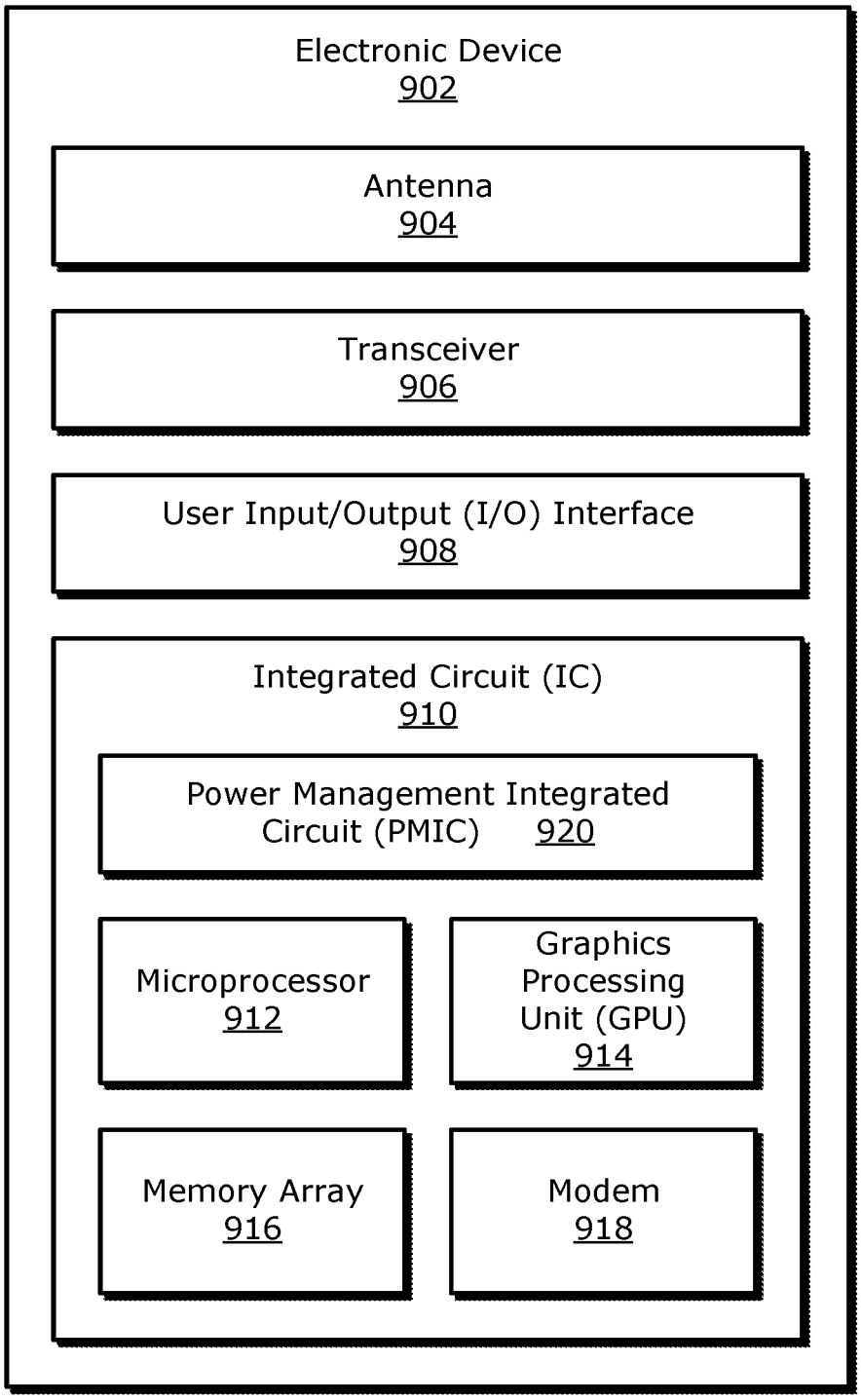
FIG. 9 illustrates an example electronic device that includes an integrated circuit having a PMIC and multiple cores.

FIG. 9 depicts an example electronic device 902 that includes an integrated circuit (IC) 910 having a power management integrated circuit 920 (PMIC) and multiple cores. As shown, the electronic device 902 includes an antenna 904, a transceiver 906, and a user input/output (I/O) interface 908 in addition to the integrated circuit 910. Illustrated examples of the integrated circuit 910, or cores thereof, include a microprocessor 912, a graphics processing unit (GPU) 914, a memory array 916, and a modem 918. In one or more example implementations, voltage regulation techniques as described herein can be implemented by the power management integrated circuit 920.

The electronic device 902 can be a mobile or battery-powered device or a fixed device that is designed to be powered by an electrical grid. Examples of the electronic device 902 include a server computer, a network switch or router, a blade of a data center, a personal computer, a desktop computer, a notebook or laptop computer, a tablet computer, a smart phone, an entertainment appliance, or a wearable computing device such as a smartwatch, intelligent glasses, or an article of clothing. An electronic device 902 can also be a device, or a portion thereof, having embedded electronics. Examples of the electronic device 902 with embedded electronics include a passenger vehicle, industrial equipment, a refrigerator or other home appliance, a drone or other unmanned aerial vehicle (UAV), or a power tool.

For an electronic device with a wireless capability, the electronic device 902 includes an antenna 904 that is coupled to a transceiver 906 to enable reception or transmission of one or more wireless signals. The integrated circuit 910 may be coupled to the transceiver 906 to enable the integrated circuit 910 to have access to received wireless signals or to provide wireless signals for transmission via the antenna 904. The electronic device 902 as shown also includes at least one user I/O interface 908. Examples of the user I/O interface 908 include a keyboard, a mouse, a microphone, a touch-sensitive screen, a camera, an accelerometer, a haptic mechanism, a speaker, a display screen, or a projector.

The integrated circuit 910 may comprise, for example, at least one power management integrated circuit 920 and one or more instances of a microprocessor 912, a GPU 914, a memory array 916, a modem 918, and so forth. The microprocessor 912 may function as a central processing unit (CPU) or other general-purpose processor. Some microprocessors include different parts, such as multiple processing cores, that may be individually powered on or off. The GPU 914 may be especially adapted to process visual-related data for display. If visual-related data is not being rendered or otherwise processed, the GPU 914 may be fully or partially powered down. The memory array 916 stores data for the microprocessor 912 or the GPU 914. Example types of memory for the memory array 916 include random access memory (RAM), such as dynamic RAM (DRAM) or static RAM (SRAM); flash memory; and so forth. If programs are not accessing data stored in memory, the memory array 916 may be powered down overall or block-by-block. The modem 918 demodulates a signal to extract encoded information or modulates a signal to encode information into the signal. If there is no information to decode from an inbound communication or to encode for an outbound communication, the modem 918 may be idled to reduce power consumption. The integrated circuit 910 may include additional or alternative parts than those that are shown, such as an I/O interface, a sensor such as an accelerometer or gyroscope, a transceiver or another part of a receiver chain, a customized or hard-coded processor such as an application-specific integrated circuit (ASIC), and so forth.

The integrated circuit 910 may also comprise a system on a chip (SOC). An SOC may integrate a sufficient number of different types of components to enable the SOC to provide computational functionality as a notebook computer, a mobile phone, or another electronic apparatus using one chip, at least primarily. Components of an SOC, or an integrated circuit 910 generally, may be termed cores or circuit blocks. A core or circuit block of an SOC may be powered down if not in use, such as by ceasing a load current draw, and the power management integrated circuit 920 may accommodate the resulting repetitive changes to the load current being drawn according to the techniques described in this document. Examples of cores or circuit blocks include, in addition to those that are illustrated in FIG. 9, a voltage regulator, a main memory or cache memory block, a memory controller, a general-purpose processor, a cryptographic processor, a video or image processor, a vector processor, a radio, an interface or communications subsystem, a wireless controller, or a display controller. Any of these cores or circuit blocks, such as a processing or GPU core, may further include multiple internal cores or circuit blocks.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Further, items represented in the accompanying figures and terms discussed herein may be indicative of one or more items or terms, and thus reference may be made interchangeably to single or plural forms of the items and terms in this written description. Finally, although subject matter has been described in language specific to structural features or methodological operations, it is to be understood that the subject matter defined in the appended claims is not necessarily limited to the specific features or operations described above, including not necessarily being limited to the organizations in which features are arranged or the orders in which operations are performed.

What is claimed is:

1. An apparatus comprising:

a voltage regulator having a regulator output node and configured to produce at least one regulator current, the voltage regulator including:

an error amplifier having a first input node, a second input node, and an error amplifier output node, the first input node coupled to a reference voltage, the error amplifier configured to generate an error amplifier output voltage at the error amplifier output node; and an output transistor coupled between the error amplifier output node and the regulator output node, the output transistor coupled to the second input node of the error amplifier via the regulator output node to establish a feedback path for the voltage regulator; and a current-controlled clamp coupled to the error amplifier output node, the current-controlled clamp configured to clamp the error amplifier output voltage based on the at least one regulator current, the current-controlled clamp including a current estimator configured to estimate the at least one regulator current of the voltage regulator to produce an estimated current.

2. The apparatus of claim 1, wherein:

the voltage regulator includes a buffer coupled between the error amplifier output node and the output transistor, the buffer including at least one branch configured to conduct the at least one regulator current; and the current estimator includes a current mirror configured to generate the estimated current based on the at least one regulator current.

3. The apparatus of claim 2, wherein:

the at least one branch includes a branch transistor configured to produce the at least one regulator current flowing through the branch transistor; and the current mirror comprises part of a parallel circuit arrangement having a mirror transistor that is coupled to the branch transistor such that the mirror transistor is configured to produce the estimated current at a level that substantially replicates that of the at least one regulator current.

4. The apparatus of claim 1, wherein the current-controlled clamp includes an error amplifier voltage clamp, the error amplifier voltage clamp configured to clamp the error amplifier output voltage based on the estimated current.

5. The apparatus of claim 4, wherein the error amplifier voltage clamp includes a voltage pulling device configured to adjust the error amplifier output voltage based on the estimated current.

6. The apparatus of claim 5, wherein the error amplifier voltage clamp includes impedance circuitry coupled to the voltage pulling device.

7. The apparatus of claim 5, wherein:

the error amplifier voltage clamp includes a difference determiner coupled to the voltage pulling device, the difference determiner configured to generate a current difference indicator based on a regulation current and the estimated current; and the voltage pulling device is configured to adjust the error amplifier output voltage based on the current difference indicator.

8. The apparatus of claim 7, wherein:

the error amplifier voltage clamp includes a current source configured to provide the regulation current; and the regulation current comprises a current level that reproduces the at least one regulator current that flows if the voltage regulator is operating in regulation.

9. The apparatus of claim 1, wherein the error amplifier comprises an operational amplifier, the operational amplifier configured to generate the error amplifier output voltage based on the reference voltage and a regulator output voltage at the regulator output node.

10. The apparatus of claim 9, wherein:

the feedback path includes feedback tuning circuitry having a feedback factor and configured to generate a feedback voltage based on the regulator output voltage and the feedback factor; and the operational amplifier is configured to generate the error amplifier output voltage based on the reference voltage and the feedback voltage.

11. The apparatus of claim 1, wherein the current-controlled clamp is configured to clamp the error amplifier output voltage so as to retard changes to a regulator output voltage at the regulator output node responsive to changes in a load current drawn by a load coupled to the regulator output node.

12. The apparatus of claim 1, further comprising:

an integrated circuit, the integrated circuit including the voltage regulator and the current-controlled clamp.

13. The apparatus of claim 12, wherein:

the integrated circuit includes at least one of logic or memory coupled to the voltage regulator; and the apparatus includes a screen operably coupled to the integrated circuit.

14. An integrated circuit comprising:

a voltage regulator having a regulator output node and configured to produce at least one regulator current, the voltage regulator including:

an error amplifier having a first input node, a second input node, and an error amplifier output node, the first input node coupled to a reference voltage, the error amplifier configured to generate an error amplifier output voltage at the error amplifier output node based on voltages at the first input node and the second input node; and an output transistor coupled between the error amplifier output node and the regulator output node, the output transistor coupled to the second input node of the error amplifier via the regulator output node to establish a feedback path for the voltage regulator; and current-controlled means for clamping the error amplifier output voltage based on the at least one regulator current, the current-controlled means comprising estimation means for estimating the at least one regulator current to produce an estimated current.

15. The integrated circuit of claim 14, wherein:

the voltage regulator includes a buffer coupled between the error amplifier output node and the output transistor, the buffer configured to conduct the at least one regulator current; and the estimation means comprises mirror means for mirroring the at least one regulator current of the buffer to produce the estimated current.

16. The integrated circuit of claim 14, wherein the current-controlled means comprises voltage clamp means for clamping the error amplifier output voltage based on the estimated current, the voltage clamp means coupled to the error amplifier output node.

17. The integrated circuit of claim 16, wherein the voltage clamp means comprises difference means for determining a current difference indicator based on the estimated current and a regulation current.

18. The integrated circuit of claim 17, wherein the voltage clamp means comprises voltage means for adjusting the error amplifier output voltage based on the current difference indicator.

19. The integrated circuit of claim 14, wherein:

the voltage regulator comprises a low-dropout voltage regulator; and the low-dropout voltage regulator includes feedback means for tuning a feedback factor of the low-dropout voltage regulator.

20. The integrated circuit of claim 14, further comprising:

a load coupled to the regulator output node, the load configured to draw a load current via the regulator output node intermittently at a relatively low level and a relatively high level, wherein the current-controlled means is configured to clamp the error amplifier output voltage based on the at least one regulator current so as to reduce a dip of a regulator output voltage at the regulator output node responsive to an onset of the relatively high level of the load current.

21. A method for current-controlled voltage regulation, the method comprising:

generating an error amplifier output voltage based on a reference voltage and a feedback voltage;

generating a regulator output voltage based on the error amplifier output voltage using a buffer that conducts at least one regulator current;

providing the feedback voltage based on the regulator output voltage;

estimating a level of the at least one regulator current to produce an estimated current; and clamping the error amplifier output voltage based on the estimated current.

22. The method of claim 21, wherein the estimating comprises mirroring the level of the at least one regulator current using a parallel circuit arrangement to produce the estimated current.

23. The method of claim 21, further comprising:

determining a current difference indicator based on the estimated current and a regulation current, wherein the clamping comprises adjusting the error amplifier output voltage based on the current difference indicator.

24. The method of claim 23, further comprising generating the regulation current so as to reproduce a current level of the at least one regulator current that flows if the regulator output voltage is in regulation.

25. The method of claim 23, wherein the adjusting the error amplifier output voltage based on the current difference indicator comprises coupling the current difference indicator to a gate of a field effect transistor (FET).

26. The method of claim 21, wherein the clamping comprises:

restoring the at least one regulator current to a current level that flows through the buffer if the regulator output voltage is in regulation; and maintaining, based on the restoring, the regulator output voltage responsive to an increase draw of load current.

27. An integrated circuit comprising:

a voltage regulator including:

an error amplifier configured to generate an error amplifier output voltage at an error amplifier output node;

a buffer coupled to the error amplifier output node and configured to conduct at least one regulator current; and an output transistor coupled to the buffer and configured to generate a regulator output voltage at a regulator output node based on the error amplifier output voltage;

a current estimator configured to estimate the at least one regulator current of the buffer to produce an estimated current; and an error amplifier voltage clamp coupled to the current estimator and configured to clamp the error amplifier output voltage based on the estimated current.

28. The integrated circuit of claim 27, wherein:

the error amplifier includes a first input node, a second input node, and the error amplifier output node;

the first input node is coupled to a reference voltage;

the voltage regulator includes a feedback path coupled between the regulator output node and the second input node, the feedback path configured to provide a feedback voltage to the second input node based on the regulator output voltage; and the error amplifier is configured to generate the error amplifier output voltage at the error amplifier output node based on a difference between the reference voltage and the feedback voltage.

29. The integrated circuit of claim 27, wherein the current estimator comprises a parallel circuit arrangement with respect to the buffer, the parallel circuit arrangement including a current reflector and a current mirror, the parallel circuit arrangement configured to produce the estimated current to be substantially similar to the at least one regulator current of the buffer using the current reflector and the current mirror.

30. The integrated circuit of claim 27, wherein the error amplifier voltage clamp comprises:

a difference determiner coupled to the current estimator and configured to produce a current difference indicator based on a regulation current and the estimated current; and a voltage pulling device coupled to the difference determiner and configured to adjust the error amplifier output voltage based on the current difference indicator.

* * * * *